US007369112B2

(12) United States Patent
Noda

(10) Patent No.: US 7,369,112 B2
(45) Date of Patent: May 6, 2008

(54) DISPLAY AND METHOD FOR DRIVING THE SAME

(75) Inventor: Kazuhiro Noda, Kanagawa (JP)

(73) Assignee: Sony Corporation (JP)

( * ) Notice: Subject to any disclaimer, the term of this patent is extended or adjusted under 35 U.S.C. 154(b) by 741 days.

(21) Appl. No.: 10/911,538

(22) Filed: Aug. 5, 2004

(65) Prior Publication Data

US 2005/0035938 A1 Feb. 17, 2005

(30) Foreign Application Priority Data

Aug. 11, 2003 (JP) ..... P2003-291413

(51) Int. Cl.
*G09G 3/36* (2006.01)

(52) U.S. Cl. ..... 345/100; 349/39; 345/87

(58) Field of Classification Search ..... 345/87–104
See application file for complete search history.

(56) References Cited

U.S. PATENT DOCUMENTS

| | | | | |
|---|---|---|---|---|
| 4,393,380 | A * | 7/1983 | Hosokawa et al. | 345/90 |
| 5,844,539 | A * | 12/1998 | Kitagawa | 345/100 |
| 6,414,729 | B1 * | 7/2002 | Akiyama et al. | 349/38 |
| 6,559,824 | B1 * | 5/2003 | Kubota et al. | 345/100 |
| 2002/0018041 | A1 * | 2/2002 | Komura et al. | 345/103 |

FOREIGN PATENT DOCUMENTS

| | | |
|---|---|---|
| JP | 03-168617 | 7/1991 |
| JP | 05-107557 | 4/1993 |
| JP | 05-143021 | 6/1993 |
| JP | 06-265846 | 9/1994 |
| JP | 10-039277 | 2/1998 |
| JP | 11-271787 | 10/1999 |
| JP | 2001-159877 | 6/2001 |

OTHER PUBLICATIONS

Japanese Office Action dated Dec. 11, 2007 for corresponding Japanese Application No. 2003-291413.

* cited by examiner

*Primary Examiner*—Amare Mengistu
*Assistant Examiner*—Jennifer Zubajlo
(74) *Attorney, Agent, or Firm*—Rader Fishman & Grauer PLLC; Ronald P. Kananen

(57) ABSTRACT

A display includes a pixel array, a vertical scan circuit, a horizontal drive circuit, and an auxiliary scan circuit. The pixel array includes scan lines, signal lines, pixels, and auxiliary scan lines. Each pixel includes a transistor, a pixel electrode, and an auxiliary capacitor. The auxiliary scan circuit sequentially applies auxiliary pulses, of which potential is reversed between a high level and a low level relative to a predetermined reference potential, to the auxiliary scan lines synchronously with selection pulses to control such that a potential of one electrode of each auxiliary capacitor in a selected pixel row is opposite in polarity to that of a signal written in the corresponding pixel electrode in the selected row, and further control such that the potential of the electrode of each auxiliary capacitor is returned to the reference potential when the selected row is released.

6 Claims, 21 Drawing Sheets

PRIOR ART

PRIOR ART

PRIOR ART

PRIOR ART

PRIOR ART

PRIOR ART

FIG. 14

| | (A) HORIZONTAL BLANKING | (B) CHANGED Cs | (C) ARRIVAL IN EFFECTIVE REGION | (D) EFFECTIVE REGION | (E) WRITING START | (F) WRITING END | (G) CLOSED GATE | (H) RETURNED Cs |
|---|---|---|---|---|---|---|---|---|
| (1) TARGET PIXEL OPEN GATE H-LEVEL WRITING | 4.0V 7.5V 2.0V 0.0V | 4.0V 5.5V 0.0V 0.0V | 4.0V 5.5V 0.0V 15.5V | 4.0V 5.5V 4.0V 15.5V | 11.0V 5.5V 4.0V 15.5V | 11.0V 5.5V 11.0V 15.5V | 11.0V 5.5V 11.0V 0.0V | 11.0V 7.5V 13.0V 0.0V |
| (2) TARGET PIXEL CLOSED GATE SIGNAL WITH REVERSE PHASE | 11.0V 7.5V 13.0V 0.0V | SAME AS LEFT | SAME AS LEFT | SAME AS LEFT | 4.0V 7.5V 13.0V 0.0V | SAME AS LEFT | SAME AS LEFT | SAME AS LEFT |
| (3) TARGET PIXEL CLOSED GATE SIGNAL WITH SAME PHASE | 4.0V 7.5V 13.0V 0.0V | SAME AS LEFT | SAME AS LEFT | SAME AS LEFT | 11.0V 7.5V 13.0V 0.0V | SAME AS LEFT | SAME AS LEFT | SAME AS LEFT |
| (4) TARGET PIXEL OPEN GATE L-LEVEL WRITING | 11.0V 7.5V 13.0V 0.0V | 11.0V 9.5V 15.0V 0.0V | 11.0V 9.5V 15.0V 15.5V | 11.0V 9.5V 11.0V 15.5V | 4.0V 9.5V 11.0V 15.5V | 4.0V 9.5V 4.0V 15.5V | 4.0V 9.5V 4.0V 0.0V | 4.0V 7.5V 2.0V 0.0V |

FIG. 15

| | (A) HORIZONTAL BLANKING | (B) CHANGED Cs | (C) ARRIVAL IN EFFECTIVE REGION | (D) EFFECTIVE REGION | (E) WRITING START | (F) WRITING END | (G) CLOSED GATE | (H) RETURNED Cs |
|---|---|---|---|---|---|---|---|---|
| (1) TARGET PIXEL OPEN GATE H-LEVEL WRITING | 2.0V, 0.0V, −2.0V | 4.0V, 0.0V, 0.0V | 4.0V, 5.5V, 0.0V, 15.5V | 0.0V, 0.0V, 11.5V | 7.0V, 0.0V, 11.5V | 0.0V, 0.0V, 4.5V | 0.0V, 0.0V, −11.0V | 0.0V, 2.0V, −11.0V |
| (2) TARGET PIXEL CLOSED GATE SIGNAL WITH REVERSE PHASE | 0.0V, 2.0V, −11.0V | SAME AS LEFT | SAME AS LEFT | SAME AS LEFT | 0.0V, 9.0V, −4.0V | SAME AS LEFT | SAME AS LEFT | SAME AS LEFT |
| (3) TARGET PIXEL CLOSED GATE SIGNAL WITH SAME PHASE | 0.0V, 9.0V, −4.0V | SAME AS LEFT | SAME AS LEFT | SAME AS LEFT | 0.0V, 2.0V, −11.0V | SAME AS LEFT | SAME AS LEFT | SAME AS LEFT |
| (4) TARGET PIXEL OPEN GATE L-LEVEL WRITING | 0.0V, 2.0V, −11.0V | 0.0V, 4.0V, −11.0V | 0.0V, 4.0V, 4.5V | 0.0V, 0.0V, 4.5V | 0.0V, 7.0V, 11.5V | 0.0V, 0.0V, 11.5V | 0.0V, 0.0V, −4.0V | 2.0V, 0.0V, −2.0V |

PRIOR ART

PRIOR ART

PRIOR ART

DISPLAY AND METHOD FOR DRIVING THE SAME

BACKGROUND OF THE INVENTION

1. Field of the Invention

The present invention relates to an active matrix display, typified by an LCD, and a method for driving the display, and more particularly, relates to a technique for driving a transistor and an auxiliary capacitor formed in each pixel of a display.

2. Description of the Related Art

FIG. 17 is a block diagram of a conventional display. The display includes a pixel array 1, a pair of vertical shift registers 2*a*, and a horizontal shift register 3*a*. The pixel array 1 includes scan lines X extending laterally, signal lines Y extending longitudinally, pixels P arranged in a matrix so as to correspond to the respective intersections of the scan lines X and the signal lines Y, and auxiliary capacitor lines Xs arranged parallel to the scan lines X. The vertical shift registers 2*a* are arranged on the right and left sides of the pixel array 1 to simultaneously drive the pixel array 1 on both the sides. In other words, each vertical shift register 2*a* sequentially applies selection pulses to the scan lines X to select the pixels P row by row. The horizontal shift register 3*a* supplies a signal VIDEO, of which potential is reversed between a high level and a low level relative to a reference potential COM, to each signal line Y to write the signal with a high or low potential into each pixel P of the selected row. Specifically, each signal line Y is connected to a common video line 3*b* through the corresponding horizontal switch HSW. The signal VIDEO is externally supplied to the video line 3*b*. The horizontal shift register 3*a* sequentially turns on or off each horizontal switch HSW to supply the signal VIDEO to the corresponding signal line Y. An image-quality improvement circuit 5 is connected to the respective signal lines Y.

Each pixel P includes a transistor Tr, a pixel electrode, and an auxiliary capacitor Cs. The transistor Tr connects to the corresponding scan line X and signal line Y and conducts in response to a selection pulse. The pixel electrode is shown by an intermediate node between the transistor Tr and the auxiliary capacitor Cs. The signal VIDEO is written into the pixel electrode through the corresponding conducting transistor Tr. The auxiliary capacitor Cs holds the signal VIDEO written in the corresponding pixel electrode. One electrode of the auxiliary capacitor Cs is connected to the corresponding transistor Tr and pixel electrode and the other electrode thereof is connected to the corresponding auxiliary capacitor line Xs, which is common to the auxiliary capacitors Cs in the same row. The auxiliary capacitor lines Xs are tied together into a bundle. The bundle is held at the predetermined reference potential COM. In other words, the potential of the electrode of each auxiliary capacitor Cs is fixed to the reference potential COM.

The display further has counter electrodes (not shown) facing the respective pixel electrodes, with a predetermined space therebetween. An electrooptic material such as liquid crystal is arranged in the space between the pixel electrodes and the counter electrodes. The counter electrodes are held at the predetermined reference potential COM. On the other hand, the potential of a signal to be written into the pixel electrode is positive or negative relative to the reference potential COM.

FIG. 18 is a schematic diagram showing the N-th stage (N-th row) and the (N+1)-th stage ((N+1)-th row) in the pixel array. As mentioned above, each pixel P includes the transistor Tr and the auxiliary capacitor Cs. One electrode of the auxiliary capacitor Cs is connected to the transistor Tr. The other electrode thereof is connected to the predetermined reference potential COM through the corresponding auxiliary capacitor line Xs. In this description, the other electrode of the auxiliary capacitor Cs may be called a Cs counter electrode.

FIG. 19 is a timing chart explaining a method for driving the conventional display in FIGS. 17 and 18. FIG. 19 shows first and second fields. In the first field, all of the scan lines are sequentially scanned once. In the second field, all the scan lines are again scanned in sequence. The N-th stage (N-th row) in the pixel array will now be described as an example. For an arbitrary horizontal period in the first field, a selection pulse (GATE) is applied to the corresponding scan line, so that the pixels in the N-th row are selected. At that time, the potential of each of the corresponding Cs counter electrodes is fixed to the reference potential COM. In the conventional display, the potential of each Cs counter electrode is always fixed to the reference potential COM irrespective of line sequential scanning. For example, a positive signal relative to the reference potential COM is written into each pixel of the selected N-th row. For the next horizontal period in the first field, pixels in the (N+1)-th row are selected. A negative signal relative to the reference potential COM is written into each pixel in the selected row. For the further next horizontal period in the first field, pixels in the (N+2)-th row are selected. A positive signal relative to the reference potential COM is written into each pixel of the selected row. As mentioned above, in the conventional display, the polarity of a video signal written in each pixel row is generally reversed every horizontal period (1H). This is called 1H reversal driving. In the second field, 1H reversal driving is similarly performed. When the first field is compared to the second field with respect to the same pixel row, it is known that the polarity of the signal in the first field is opposite to that in the second field. In other words, 1F reversal driving is performed. The N-th pixel row will now be described as an example. The positive video signal is written in the pixels in the N-th row in the first field. In the second field, a negative video signal is written into the same pixels.

Japanese Unexamined Patent Application Publication Nos. 11-271787 and 2001-159877 disclose methods for driving the above-mentioned conventional display.

In an active matrix display, generally, each pixel includes a transistor for writing a signal into the corresponding pixel electrode and an auxiliary capacitor for holding the signal written in the pixel electrode. Each of the above-mentioned active and passive devices includes a thin-film device having a thin layer of, for example, silicon. In conventional driving methods, to stably hold a signal in one field, it is desirable that the capacitance of the auxiliary capacitor of each pixel be increased. The increase in capacitance of the auxiliary capacitor prevents light leak in the transistor. On the other hand, the width of a channel of the transistor is narrowed to reduce the leak. Therefore, the resistance of the channel in the transistor is increased. The current drive capacity tends to be restricted. This leads to the limitation of a capacity to charge the auxiliary capacitor. As mentioned above, the conventional technique has inconsistent conditions, namely, the increase in capacitance of the auxiliary capacitor and the increase in resistance of the transistor. Unfortunately, the conventional technique can hardly overcome disadvantages such as insufficient signal writing and a spot defect caused by leak. As the definition of the active matrix display becomes higher, the number of pixels increases more sharply. Write time for each pixel is reduced inversely proportional to the increase in number of pixels. Disadvantageously, image quality is seriously deteriorated due to the insufficient signal writing and the spot defect caused by leak.

To overcome the above-mentioned disadvantages, a common reversing method has conventionally been provided. According to the method, synchronously with 1H reversal driving of a video signal, a potential of each counter electrode (common electrode) is reversed so as to be opposite in phase to that of the video signal relative to a reference potential. Synchronously with reversing the counter electrode, the potential of the Cs counter electrode of each auxiliary capacitor is also reversed. According to the common reversing method, however, the potential of each of the counter electrodes arranged in all of the pixels is changed between a positive level and a negative level every horizontal period (1H). Thus, the extremely large amount of charge is required. Actually, it is difficult to charge or discharge the counter electrodes at a high rate. The common reversing method is not exactly an effective solution.

SUMMARY OF THE INVENTION

In consideration of the above-mentioned disadvantages, it is an object of the present invention to improve a method for driving pixel transistors and auxiliary capacitors to eliminate image quality deterioration caused by insufficient signal writing and a spot defect generated by leak. To accomplish the above object, the present invention provides a display including: a pixel array including scan lines extending laterally, signal lines extending longitudinally, pixels arranged in a matrix so as to correspond to the intersections of the scan lines and the signal lines, and auxiliary scan lines extending parallel to the scan lines; a vertical scan circuit for sequentially applying selection pulses to the scan lines to sequentially select the pixels row by row; a horizontal drive circuit for supplying a signal, of which potential is reversed between a high level and a low level relative to a predetermined reference potential, to each signal line to write the signal with a high or low potential to the pixels in the selected row; and an auxiliary scan circuit, operatively associated with the vertical scan circuit, for sequentially applying auxiliary pulses to the auxiliary scan lines, wherein each pixel includes a transistor, which connects to the corresponding scan line and signal line and conducts in response to the selection pulse, a pixel electrode to which the signal is written through the conducting transistor, and an auxiliary capacitor for holding the written signal, one electrode of each auxiliary capacitor is connected to the corresponding transistor and the other electrode thereof is connected to the corresponding auxiliary scan line that is common to the auxiliary capacitors in the same row, and the auxiliary scan circuit sequentially applies the auxiliary pulses, of which potential is reversed between a high level and a low level relative to the predetermined reference potential, to the auxiliary scan lines synchronously with the selection pulses to control such that the potential of the electrode of each auxiliary capacitor in the selected row is opposite in polarity to that of the signal written in the corresponding pixel electrode in the selected row, and further control such that the potential of the electrode of each auxiliary capacitor is returned to the reference potential when the selected row is released.

Preferably, the horizontal drive circuit reduces the amplitude of the signal, of which potential is opposite in polarity to that of the auxiliary pulse, by the difference between the reference potential and the reversed potential of the auxiliary pulse, and then supplies the resultant signal to each signal line. Preferably, just before a selection pulse is applied to each scan line, the auxiliary scan circuit applies an auxiliary pulse to the corresponding auxiliary scan line, and stops applying the auxiliary pulse to the auxiliary scan line just after applying the selection pulse to the corresponding scan line is terminated. Preferably, the horizontal drive circuit writes a signal, of which potential is reversed every row, into each pixel row, and the auxiliary scan circuit applies an auxiliary pulse, of which potential is reversed every row so as to be opposite in polarity to that of the signal, to each auxiliary scan line. The present display further includes counter electrodes facing the respective pixel electrodes, with a predetermined space therebetween. Liquid crystal is arranged in the space, each counter electrode is held at the predetermined reference potential, and the potential of the signal written in each pixel electrode and that of the electrode of the corresponding auxiliary capacitor are opposite in polarity to each other and are reversed between a positive potential and a negative potential relative to the reference potential.

According to the present invention, auxiliary pulses, of which potential is reversed relative to the reference potential, are sequentially applied to the auxiliary scan lines, thus controlling such that the potential of the Cs counter electrode of each auxiliary capacitor in the selected row is opposite in polarity to that of a signal written in each of the corresponding pixel electrodes in the selected row. In addition, when the selected row is released, the potential of the Cs counter electrode of each of the corresponding auxiliary capacitors is returned to the reference potential. As mentioned above, while the common electrodes of the auxiliary capacitors are scanned row by row, the potential of the Cs counter electrode of each auxiliary capacitor is changed, thus varying the operating point of the corresponding pixel transistor connected to the other electrode of each auxiliary capacitor. Varying the operating point of the pixel transistor increases the current drive capacity, so that the conventional disadvantage such as insufficient signal writing in the pixel electrodes can be overcome. Thus, a spot defect can be eliminated. According to such a method, inversely proportional to the increased current drive capacity of each pixel transistor, the amplitude of an input signal can be reduced as compared to the conventional one. Consequently, a spot defect generated by leak and image quality defects such as lateral crosstalk, longitudinal crosstalk, and a window strip can be remarkably eliminated. These defects depend on the signal amplitude and are conventional problems. The lateral crosstalk laterally appears parallel to the scan lines in the pixel array. The longitudinal crosstalk longitudinally appears parallel to the signal lines in the pixel array. The window strip means a strip defect that appears when a window is displayed in the pixel array. In addition, according to the method of the present invention, the common electrodes of the auxiliary capacitors of the pixels are scanned row by row. It is unnecessary to change the very large capacitance of each counter electrode. Accordingly, high-speed scanning can be realized.

As mentioned above, the common electrodes of the auxiliary capacitors of the pixels are scanned row by row and the potential of each common electrode is changed, thus obtaining the following advantages. First, the amount of supply current to each pixel transistor is increased. Even when each auxiliary capacitance is increased, a spot defect is not generated by insufficient signal writing. Second, the amplitude of a video signal distributed to each signal line is reduced. Thus, a spot defect caused by light leak can be eliminated. Third, a variation in amplitude of a signal supplied to the signal line is little. Consequently, image quality defects such as longitudinal crosstalk, lateral crosstalk, a window strip depending on the amplitude can be eliminated. Fourth, the common electrodes of the auxiliary capacitors of the pixels are scanned row by row. Thus, the large amount of charge is not needed. High-speed scanning can be realized.

BRIEF DESCRIPTION OF THE DRAWINGS

FIG. 14 is a table explaining the operation of a pixel transistor built in the display according to the present invention;

FIG. 15 is a table explaining the operation of the pixel transistor built in the display according to the present invention;

DESCRIPTION OF THE PREFERRED EMBODIMENTS

Figure 1:
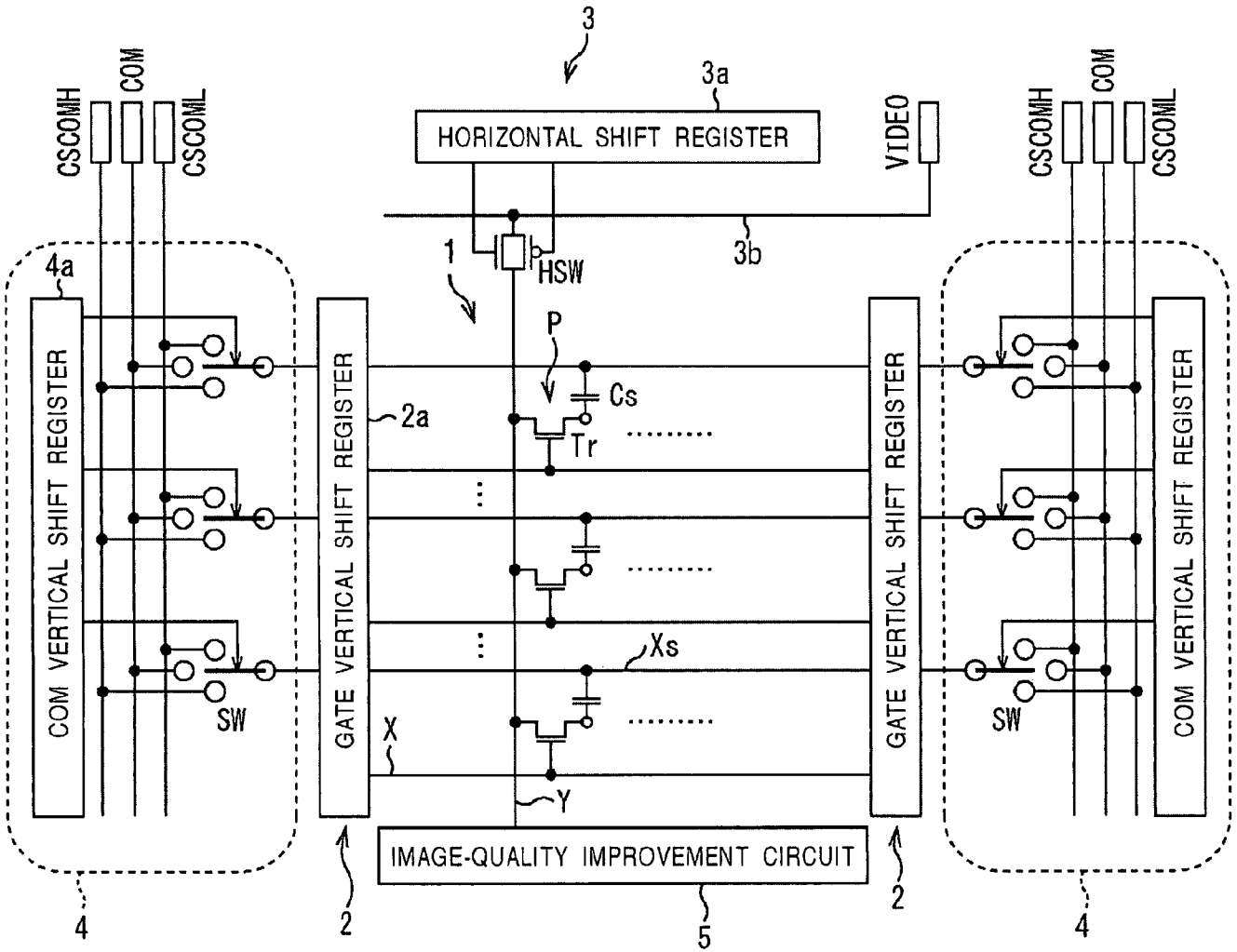
FIG. 1 is a block diagram of the entire structure of a display according to the present invention.

An embodiment of the present invention will now be described below in detail with reference to the drawings. FIG. 1 is a block diagram of the entire structure of a display according to the present invention. The present display fundamentally includes a pixel array 1, a vertical scan circuit 2, a horizontal drive circuit 3, and an auxiliary scan circuit 4. The pixel array 1 includes scan lines x extending laterally, signal lines Y extending longitudinally, pixels P arranged in a matrix so as to correspond to the intersections of the scan lines X and the signal lines Y, and auxiliary scan lines Xs. The vertical scan circuit 2 includes one pair of gate vertical shift registers 2*a* arranged on the right and left sides of the pixel array 1 to simultaneously drive the pixel array 1 on both the sides. Specifically speaking, the vertical scan circuit 2 sequentially applies selection pulses to the scan lines X to sequentially the pixels P row by row.

The horizontal drive circuit 3 is arranged above the pixel array 1. The horizontal drive circuit 3 supplies a signal VIDEO, of which potential is reversed between a high level and a low level relative to a predetermined reference potential COM, to each signal line Y and writes the signal having a positive or negative potential to each pixel P in the selected row. According to the present embodiment, the horizontal drive circuit 3 includes a horizontal shift register 3*a* and horizontal switches HSW connected to the ends of the respective signal lines Y. The signal VIDEO externally supplied is sent through a common video line 3*b* and is supplied to each signal line Y through the corresponding horizontal switch HSW. At that time, the horizontal shift register 3*a* sequentially turns on and off the horizontal switches HSW to supply the signal VIDEO to the signal lines Y. An image-quality improvement circuit 5 is connected to the other ends of the respective signal lines Y. The image-quality improvement circuit 5 precharges the signal lines Y before the video signals VIDEO are distributed to the signal lines Y, thus improving the quality of an image displayed in the pixel array 1.

The auxiliary scan circuit 4 includes a pair of auxiliary scan circuit segments. The circuit segments are also arranged on the right and left sides of the pixel array 1, respectively. The auxiliary scan circuit 4 is operatively associated with the vertical scan circuit 2, and sequentially applies auxiliary pulses to the auxiliary scan lines Xs. According to the present embodiment, each circuit segment of the auxiliary scan circuit 4 includes switches SW arranged in the respective stages (rows) of the pixel array 1 and a COM vertical shift register 4*a* for sequentially turning on and off the switches SW.

Each pixel P includes a transistor Tr, a pixel electrode, and an auxiliary capacitor Cs. The transistor Tr connects to the corresponding scan line X and signal line Y and conducts in response to the selection pulse. According to the present embodiment, the transistor Tr includes a field-effect thin-film transistor having a gate to control a channel, a source, and a drain, the source and the drain being located at both the ends of the channel. The gate connects to the corresponding scan line X. The source connects to the corresponding signal line Y. The drain connects to the corresponding pixel electrode. According to the present embodiment, 1H reversal driving is performed. Therefore, the direction of a current flowing through the channel is changed every horizontal period (1H). In accordance with the change, the source and the drain change places. A signal is written into the pixel electrode through the conducting transistor Tr. Referring to FIG. 1, each pixel electrode corresponds to an intermediate node between the auxiliary capacitor Cs and the transistor Tr. Each pixel electrode is shown by reference mark ○. Each auxiliary capacitor Cs holds the signal written in the corresponding pixel electrode for one field period. One electrode of each auxiliary capacitor Cs is connected to the drain or source of the corresponding transistor Tr. The other electrode (Cs counter electrode) thereof is connected to the corresponding auxiliary scan line Xs that is common to the auxiliary capacitors Cs in the same row.

In the above-mentioned arrangement, the auxiliary scan circuit 4 sequentially applies an auxiliary pulse to each auxiliary scan line Xs synchronously with the application of a selection pulse. The polarity of the auxiliary pulse is reversed between a high level CSCOMH and a low level CSCOML relative to the predetermined reference potential COM. Thus, the auxiliary scan circuit 4 controls such that the potential of the Cs counter electrode of each auxiliary capacitor Cs in the selected row is opposite in polarity to that of the signal written in the pixel electrode in the selected row and also controls such that the potential of the Cs counter electrode of each auxiliary capacitor Cs is returned from the potential CSCOMH or CSCOML to the reference potential COM when the selected row is released. The horizontal drive circuit 3 reduces the amplitude of the signal VIDEO, of which polarity is opposite to that of the auxiliary pulse, by the difference between the reference potential COM and the reversed potential CSCOMH or CSCOML of the auxiliary pulse and then supplies the resultant signal to each signal line Y.

According to the present embodiment, just before the selection pulse is applied to any scan line X, the auxiliary scan circuit 4 applies the auxiliary pulse to the corresponding auxiliary scan line Xs. Just after applying the selection pulse is terminated, the auxiliary scan circuit 4 stops applying the auxiliary pulse to the auxiliary scan line Xs. The high potential CSCOMH and the low potential CSCOML for the auxiliary pulse are externally supplied to a panel including the pixel array 1. The present invention is not limited to this arrangement. The potentials CSCOMH, CSCOML, and COM can be previously combined to each other on the outside and be then supplied to the auxiliary scan circuit 4 in the panel.

According to the present embodiment, the horizontal drive circuit 3 writes the signal VIDEO to each pixel row. The potential of the signal VIDEO is reversed between a positive polarity and a negative polarity every row. Synchronously with the writing, the auxiliary scan circuit 4 applies the auxiliary pulse to each auxiliary scan line Xs. The potential of the auxiliary pulse is reversed between CSCOMH and CSCOML every row such that the polarity of the auxiliary pulse is opposite to that of the signal VIDEO. In other words, the display according to the present embodiment performs 1H reversal driving. In accordance with the 1H reversal driving, the auxiliary scan circuit 4 drives the counter electrode of each auxiliary capacitor in a 1H reversal driving manner. In this 1H reversal driving,.the potential of the video signal VIDEO is opposite in phase to that of the Cs counter electrode.

The present display includes counter electrodes facing the respective pixel electrodes, with a predetermined space therebetween. An electrooptic material such as liquid crystal is arranged in the space between the pixel electrodes and the counter electrodes. Each counter electrode is held at the predetermined reference potential COM. The potential of the signal written in each pixel electrode is opposite in polarity to that of the Cs counter electrode of the corresponding auxiliary capacitor such that the potentials are switched between a positive polarity and a negative polarity relative to the reference potential COM.

Figure 2A:
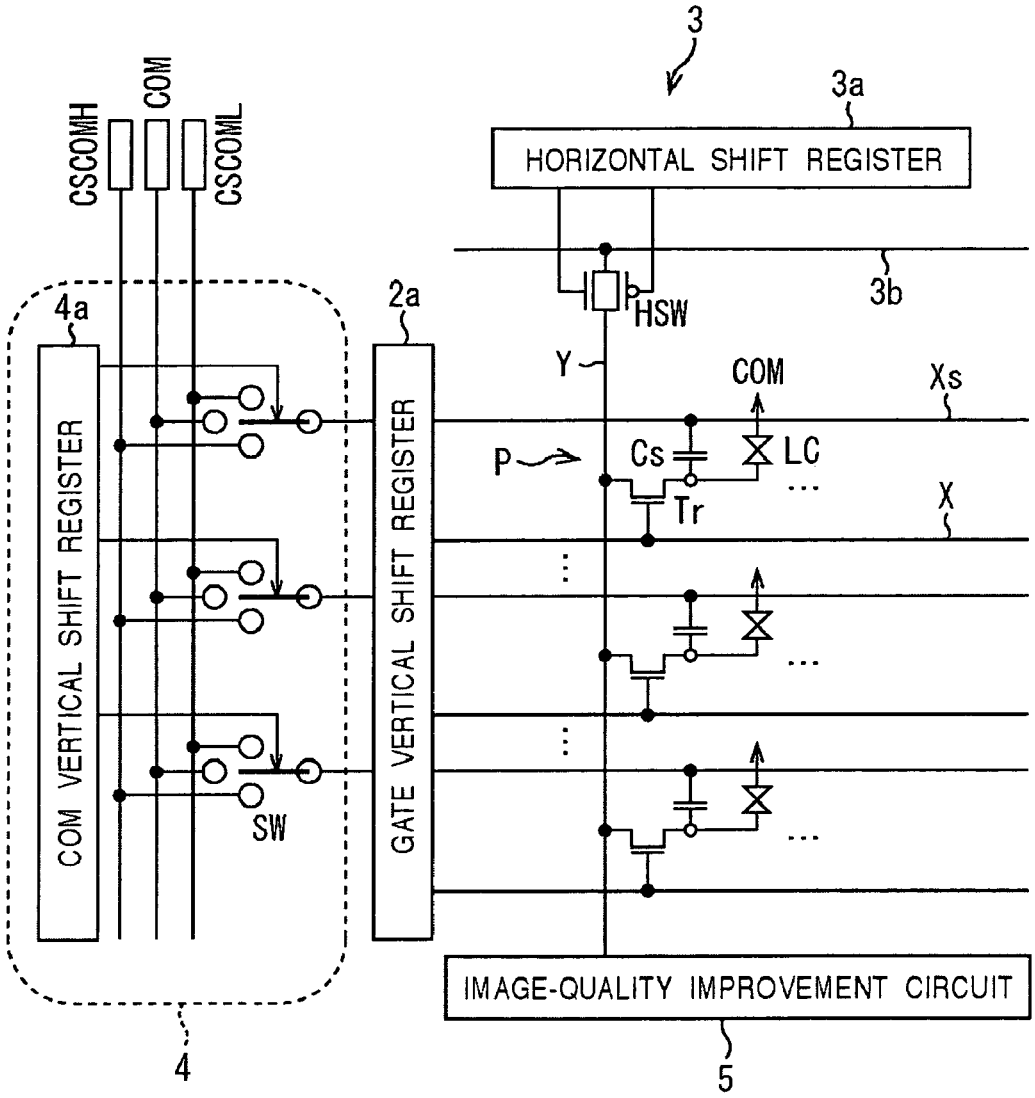
FIG. 2A is a partial block diagram of an essential part of the display according to the present invention.

FIG. 2A is a partial block diagram of an essential part of the display in FIG. 1. Referring to FIG. 2A, the scan lines X are connected to the vertical shift register 2*a* and the auxiliary scan lines Xs are connected to the circuit segment of the auxiliary scan circuit 4. On the other hand, the signal lines Y are connected to the horizontal shift register 3*a* and the image-quality improvement circuit 5. The pixels P are formed at the respective intersections of the scan lines X and the signal lines Y. Each pixel P includes the transistor Tr, a liquid crystal cell LC, and the auxiliary capacitor Cs. The liquid crystal cell LC includes liquid crystal disposed between the corresponding pixel electrode and counter electrode. The counter electrode in the liquid crystal cell LC is connected to the reference potential COM. The pixel electrode in the liquid crystal cell LC is connected to the drain of the corresponding transistor Tr. On the other hand, one electrode (Cs counter electrode) of the auxiliary capacitor Cs is connected to the corresponding auxiliary scan line Xs and the other electrode is connected to the drain of the corresponding transistor Tr. In the conventional display, the counter electrode in the liquid crystal cell LC and the Cs counter electrode of the auxiliary capacitor Cs are fixed to the reference potential COM. On the contrary, according to the present invention, the auxiliary scan circuit 4 scans the Cs counter electrodes of the auxiliary capacitors Cs row by row, which leads to 1H reversal driving.

Figure 2B:
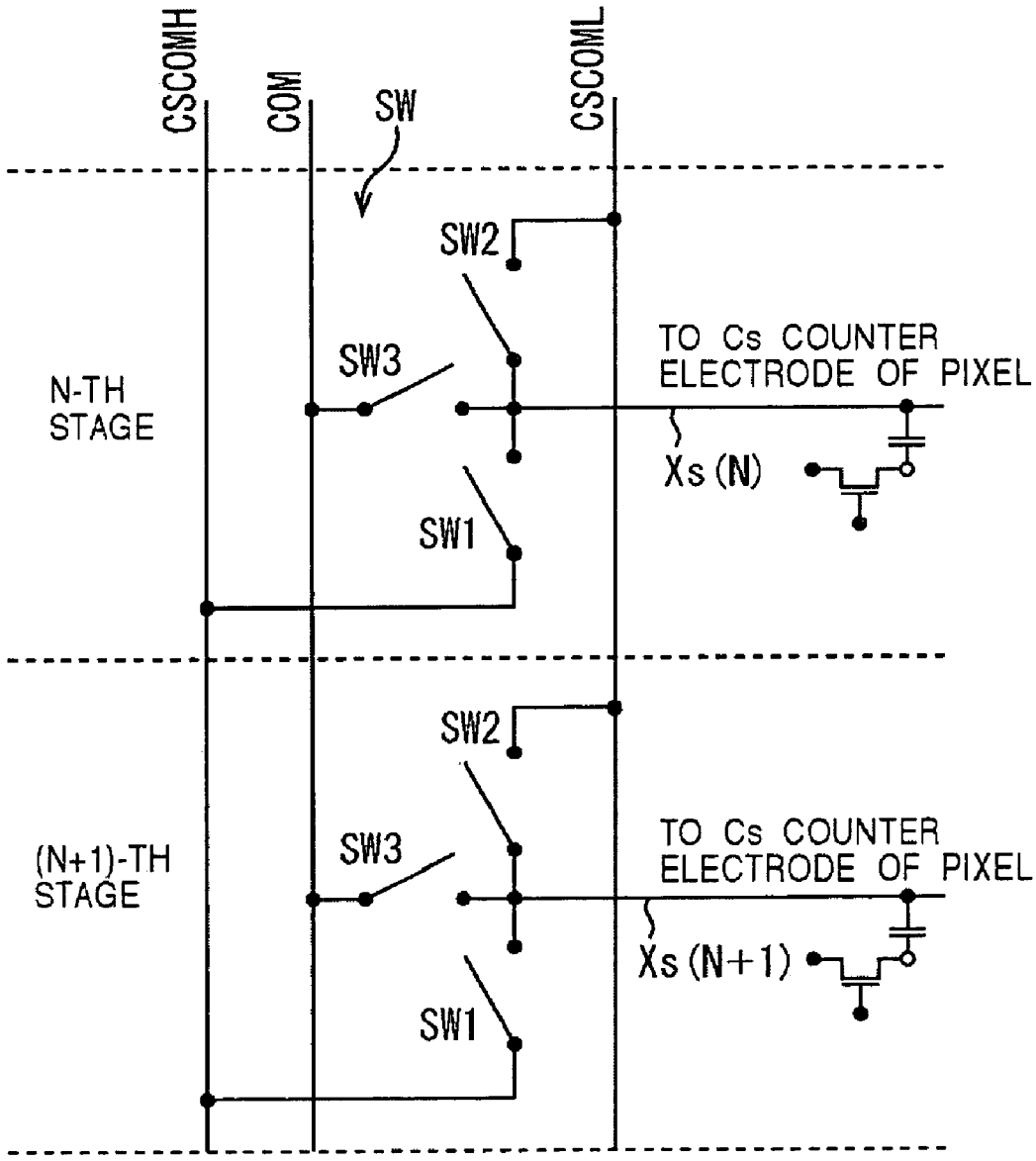
FIG. 2B is a circuit diagram of the concrete configuration of an auxiliary scan circuit build in the display according to the present invention.

FIG. 2B is a circuit diagram of the concrete configuration of the circuit segment of the auxiliary scan circuit 4 in FIG. 2A. For the sake of clarity, two rows, namely, the N-th and (N+1)-th stages are shown. In the circuit segment of the auxiliary scan circuit 4, the switch SW corresponding to the N-th stage is actually composed of three switch segments SW1, SW2, and SW3. A common output terminal of the switch segments SW1, SW2, and SW3 is connected to the corresponding N-th auxiliary scan line Xs(N) and is further connected to the Cs counter electrodes of the pixels in the N-th row. The potential CSCOMH that is higher (level "H") than the reference potential COM is supplied to an input terminal of the switch segment SW1. The potential CSCOML that is lower (level "L") than the reference potential COM is supplied to an input terminal of the switch segment SW2. The reference potential COM is supplied to an input terminal of the switch segment SW3. The switch SW in the next (N+1) stage has the same configuration. An output terminal thereof is connected to the corresponding (N+1)-th auxiliary scan line Xs(N+1).

Figure 2C:
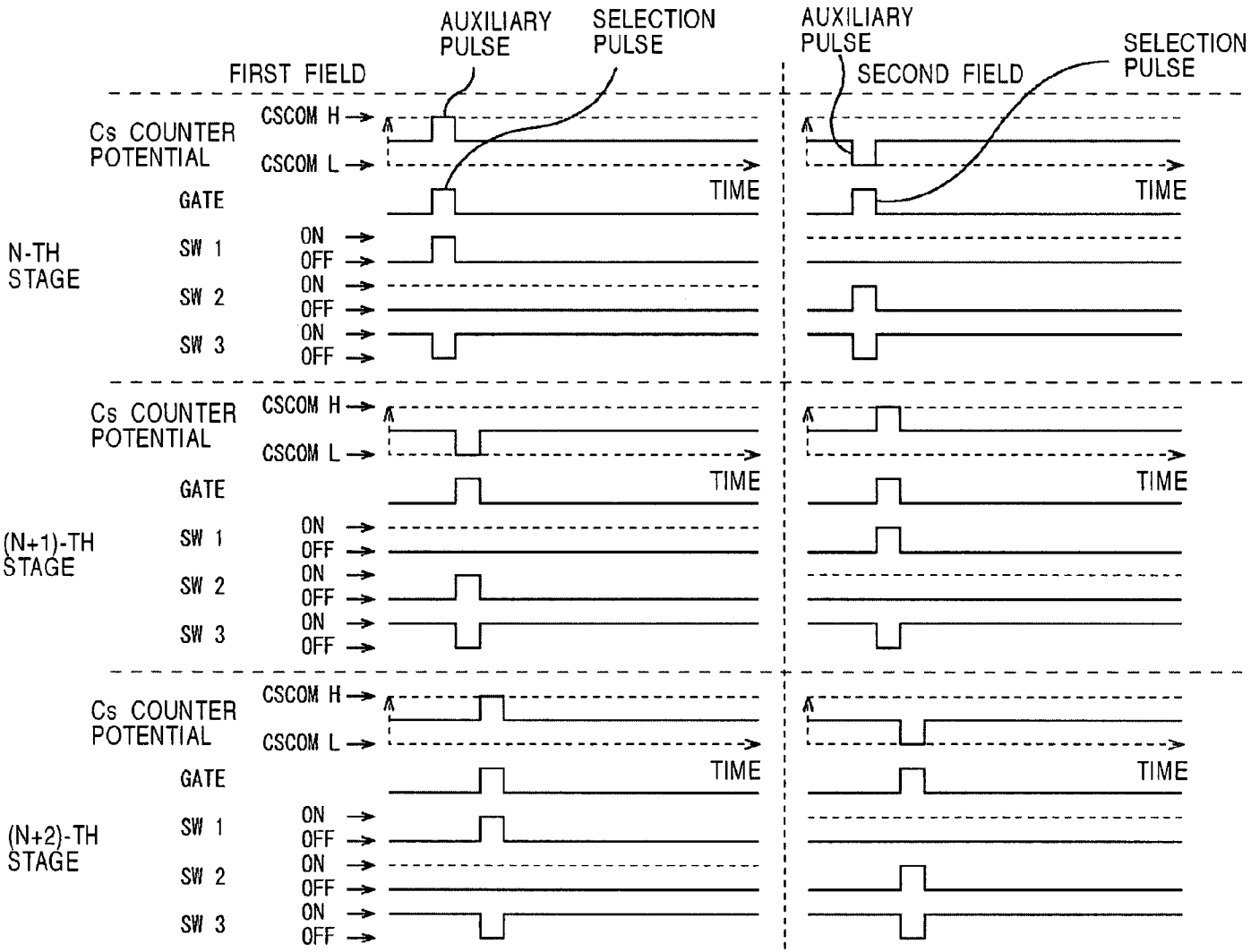
FIG. 2C is a timing chart explaining the operation of the display according to the present invention.

FIG. 2C is a timing chart explaining the operations of the vertical scan circuit and the auxiliary scan circuit shown in FIGS. 2A and 2B. First, the N-th stage in the first field will now be described. For an arbitrary horizontal period (1H), the vertical scan circuit generates a selection pulse (GATE) to the N-th scan line X to select the pixels in the N-th row. The horizontal drive circuit writes a video signal with a negative polarity into each pixel in the selected N-th row. Synchronously with the generation of the selection pulse GATE, the auxiliary scan circuit generates an auxiliary pulse to the N-th auxiliary scan line Xs. The auxiliary pulse defines the potential of the Cs counter electrode (Cs counter potential CSCOM) of the auxiliary capacitor Cs. In this case, the potential CSCOM goes to the level "H". When the auxiliary pulse is released, the potential of the Cs counter electrode is returned to the reference potential COM. To generate the above-mentioned auxiliary pulse, the switch segment SW1 is turned on and the switch segment SW3 is turned off. As mentioned above, the negative signal is written to each pixel in the N-th row and each Cs counter potential in the N-th row is controlled at a positive level (level "H").

For the next horizontal period in the first field, the vertical scan circuit generates a selection pulse to the (N+1)-th scan line X to select the pixels in the (N+1)-th row. A positive signal, of which polarity is opposite to that of the signal in the N-th row, is written into each pixel in the selected (N+1)-th row. Synchronously with the selection pulse, the auxiliary scan circuit generates an auxiliary pulse to the (N+1)-th auxiliary scan line Xs. The potential of this auxiliary pulse is negative that is opposite to the polarity of the auxiliary pulse in the N-th row. As mentioned above, in the (N+1)-th stage, the potential of the signal written in each pixel in the selected row is opposite in phase to that of the corresponding Cs counter electrode. In the (N+2)-th stage, the potential of a signal written into each pixel of this row is negative. On the other hand, the potential of each Cs counter electrode is positive. As mentioned above, the polarity of the auxiliary pulse is reversed every horizontal period (1H). In other words, 1H reversal driving is performed. The polarity of the signal written in each pixel of the selected row is also reversed every horizontal period. 1H reversal driving is similarly performed. The 1H reversal driving for the video signal is opposite in phase to that for the Cs counter electrode. In the second field, 1H reversal driving is similarly performed with respect to the video signal and the Cs counter potential. In the second field, the polarity of an auxiliary pulse applied to the same row is opposite to that in the first field. In other words, the polarity thereof is reversed every field (1F reversal). In association with the 1F reversal, The polarity of a video signal is also reversed every field.

Figure 3:
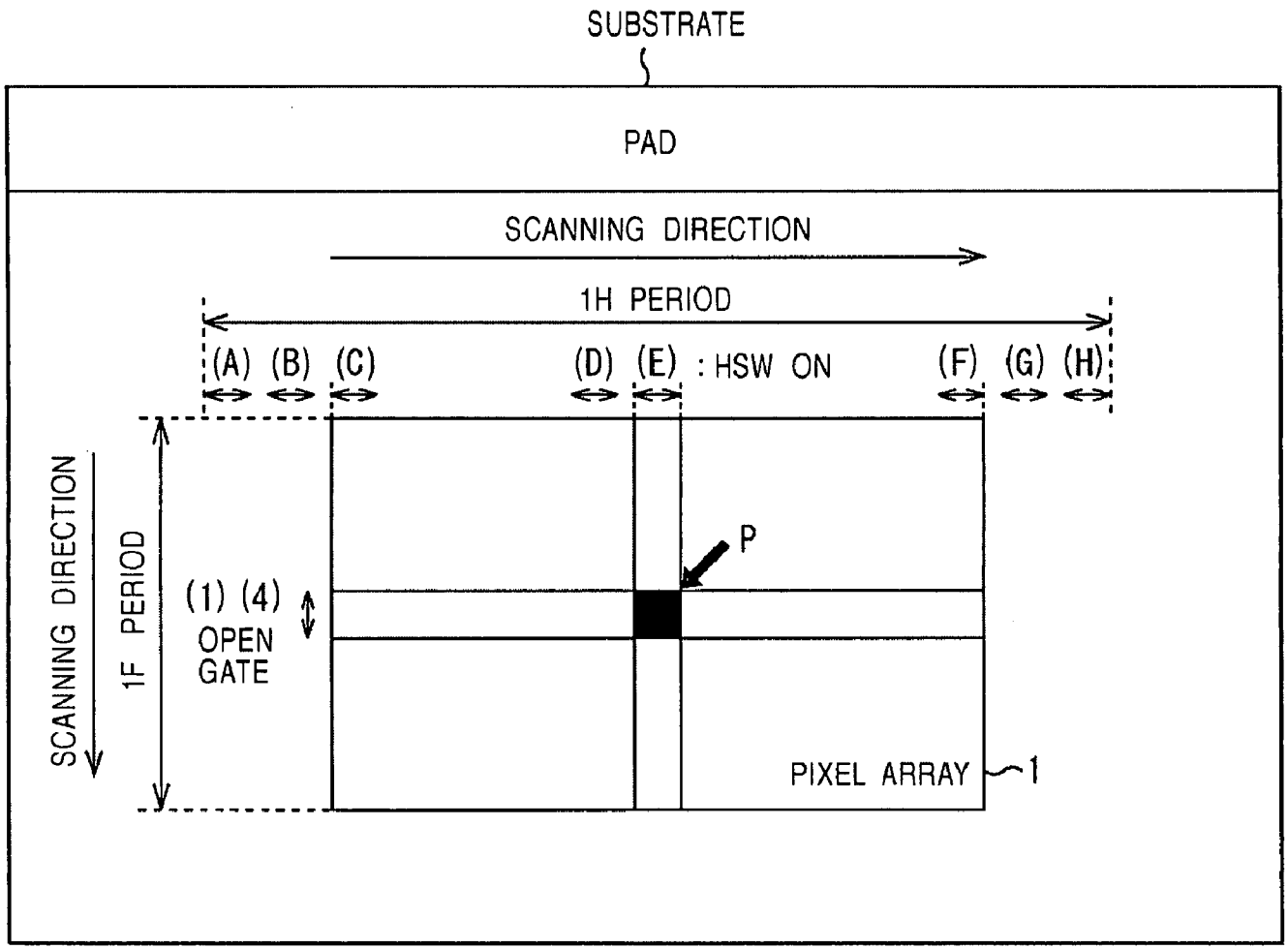
FIG. 3 is a schematic diagram showing a target pixel set for description of the display according to the present invention.

Features of the present invention will now be described concretely and in detail with reference to FIGS. 3 to 16 in comparison with the conventional display. FIG. 3 schematically shows a target pixel P in the panel with respect to position and time. The panel constituting the display includes a rectangular substrate. The pixel array 1 is disposed at the center of the substrate. The vertical scan circuit, the horizontal drive circuit, and the auxiliary scan circuit (which are not shown) are disposed in the vicinity of the pixel array 1. A PAD to connect the above circuits to the outside is formed in the upper end of the substrate. A pixel located in the vicinity of the center of the pixel array 1 in the panel is set to the target pixel P to be considered for description. Assuming that the PAD is disposed in the upper portion of the panel, each signal line is scanned from left to right for one horizontal (1H) period. Reference symbols (A), (B), (C) each denote time for one horizontal period. The scan lines are scanned from top to bottom in the panel for one field (1F) period. Reference numerals (1) to (4) each denote time for one field period. Referring to FIG. 3, the gate of the target pixel P is opened at time (1), so that the target pixel P is selected. At time (4) for the next 1F period, the gate is similarly opened, so that the target pixel P is again selected. Synchronously with the opening, the corresponding horizontal switch HSW is turned on at time (E) for 1H period, so that a signal is written into the target pixel P. Provided that 1H reversal driving is used as a driving method, a signal having an amplitude of 7.5 V±5.5 V is supplied to the panel. The highest level is 13.0 V. The lowest level is 2.0 V. 1F reversal driving is also used. A signal, of which polarity is reversed every field, is written into the target pixel P. According to the present invention, for the polarity of the counter electrode facing the corresponding pixel electrode, with liquid crystal therebetween, the polarity is ideally fixed to a reference potential, namely, 7.5 V as in the case of the conventional display.

Figure 4:
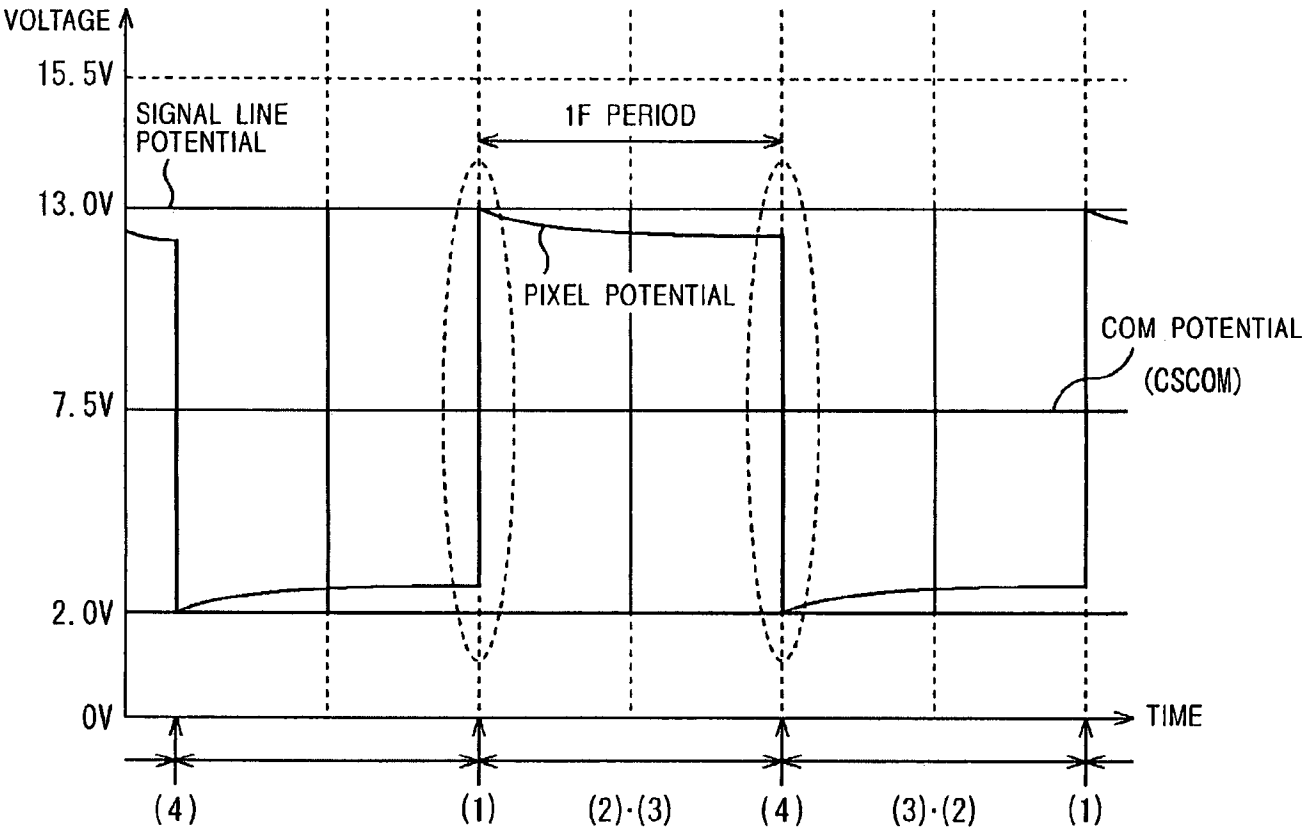
FIG. 4 is a waveform chart explaining a method for driving a conventional display.

FIG. 4 shows a change in potential (pixel potential) of the pixel electrode of the target pixel P and a change in potential (signal line potential) of the corresponding signal line in a panel of the conventional display in the fields. The axis of ordinate denotes voltage and the axis of abscissa denotes elapsed time of vertical scanning. For the signal line potential, 1H reversal driving is performed such that the potentials at the levels "H" and "L" alternately appear every row. The potentials are high and low relative to the potential COM of the counter electrode. At time (1), the target pixel is set to the pixel potential at the level "H" and is held for 1F period. After that, at time (4), the target pixel P is set to the signal line potential at the level "L". At time (2) and time (3), the target pixel P is not selected and the gate is closed.

Figure 5:
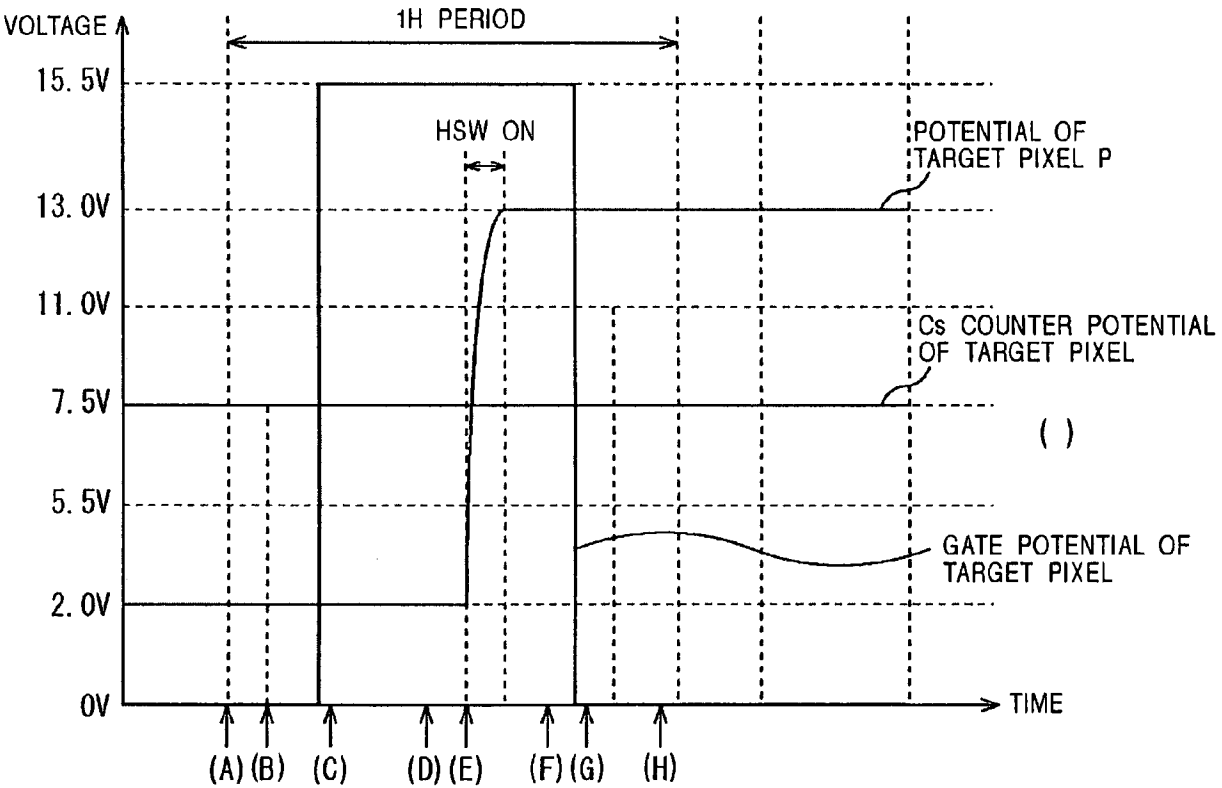
FIG. 5 is an enlarged view of the waveform in FIG. 4.

FIG. 5 shows a change in pixel potential of the target pixel P at time (1) at which the target pixel P is set to the high potential in FIG. 4. The axis of ordinate indicates voltage and the axis of abscissa denotes elapsed time of horizontal scanning. More specifically, FIG. 5 shows changes in gate potential, pixel potential, and Cs counter potential for 1H period corresponding to time (1). As mentioned above, at time (1), the potential of the pixel P is changed from the level "L" to the level "H". First, at time (A), horizontal blanking terminates. At time (C), the gate potential of the target pixel P rises. After that, at time (G), the gate potential of the target pixel P falls. At time (H), horizontal blanking starts. Since the target pixel P is located in the vicinity of the center of the pixel array, the corresponding horizontal switch HSW is turned on at time (E) for 1H period. Thus, the potential of the target pixel P is changed from the level "L" to the level "H". After that, when the gate potential of the target pixel P falls, the potential of the target pixel P is fixed and is held for 1F period. As mentioned above, in the conventional display, the Cs counter potential is fixed to the reference potential.

Figure 6:
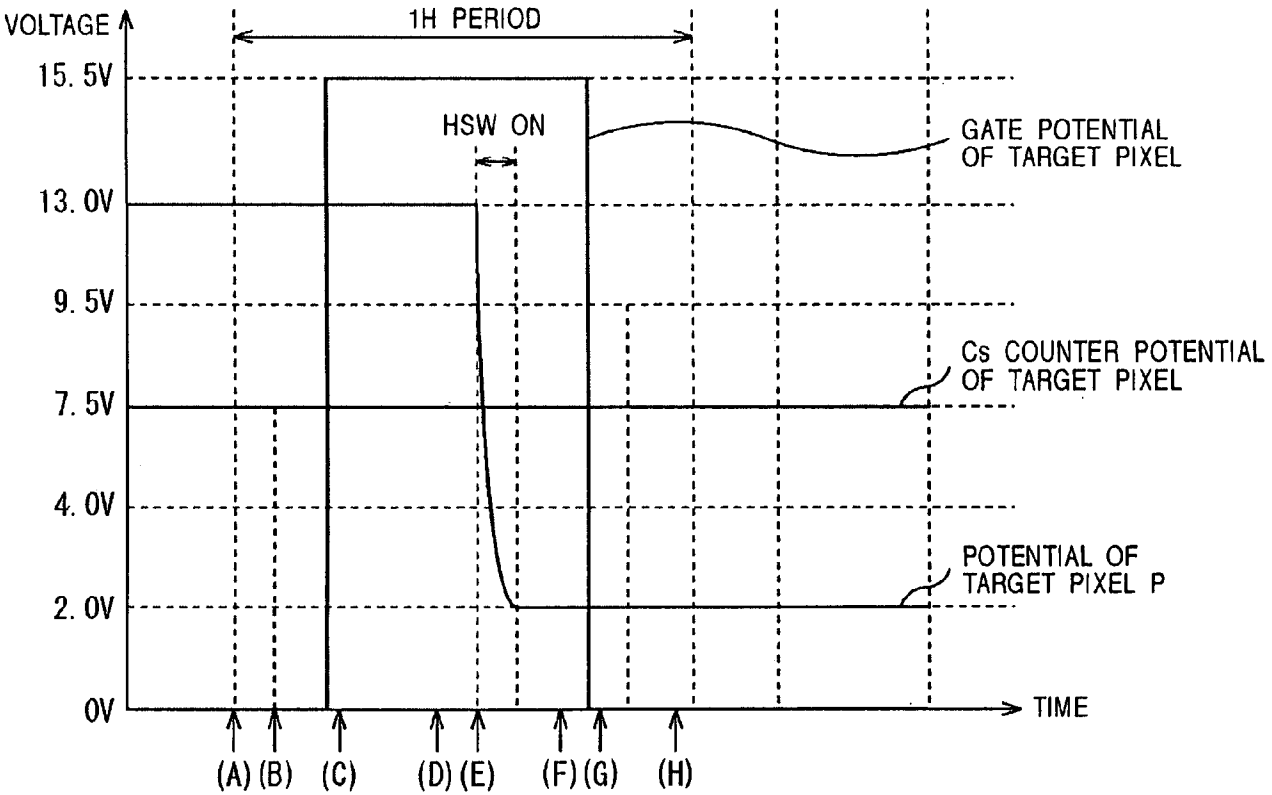
FIG. 6 is an enlarged view of the waveform in FIG. 4.

FIG. 6 shows a change in potential in the case where the potential of the target pixel P is changed from the level "H" to the level "L" at time (4) in vertical scanning. At time (C) for 1H period, the gate of the target pixel P is opened, so that the target pixel P is selected. After that, at time (E), the corresponding horizontal switch HSW is turned on, so that the potential of the signal written in the target pixel P is changed from the level "H" to the level "L". After that, at time (G), the gate potential of the target pixel P falls. The changed potential is fixed for the next 1F period.

Figure 7:
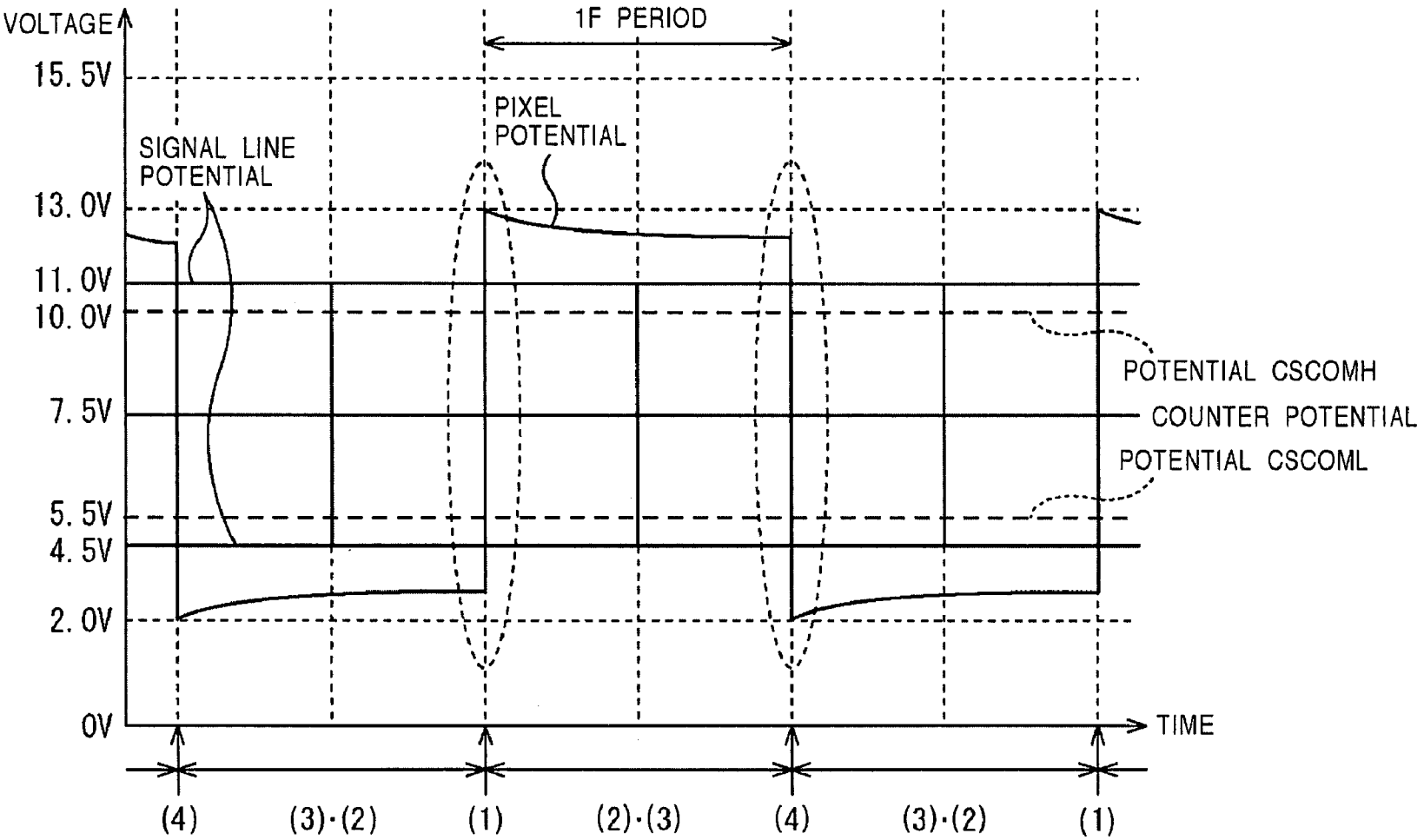
FIG. 7 is a waveform chart explaining a method for driving the display according to the present invention.

FIG. 7 macroscopically shows a change in pixel potential and a change in signal line potential of the target pixel P for 1F period according to the present invention. The axis of ordinate denotes voltage and the axis of abscissa denotes elapsed time in vertical scanning. For the signal line potential, 1H reversal driving is performed such that the potentials at the levels "H" and "L" alternately appear every row. The potentials are high and low relative to the potential of the counter electrode. The amplitude of a signal is 7.5 V±3.5 V. As compared to the conventional display, each of the highest level and the lowest level is reduced by 2 V. For the potential of the Cs counter electrode of the auxiliary capacitor Cs, 1H reversal driving is also performed. The potential of the Cs counter electrode of the auxiliary capacitor Cs is controlled between CSCOMH and CSCOML, which are opposite in phase to each other relative to the potential of the counter electrode. According to the present embodiment, the high potential CSCOMH of the Cs counter electrode is set to 10.0 V and the low potential CSCOML thereof is set to 5.5 V.

Referring to FIG. 7, at time (1), the pixel potential is changed from the level "L" to the level "H" and is held for 1F period. At the next time (4), the pixel potential is changed from the level "H" to the level "L" and is similarly held for the next 1F period.

Figure 8:
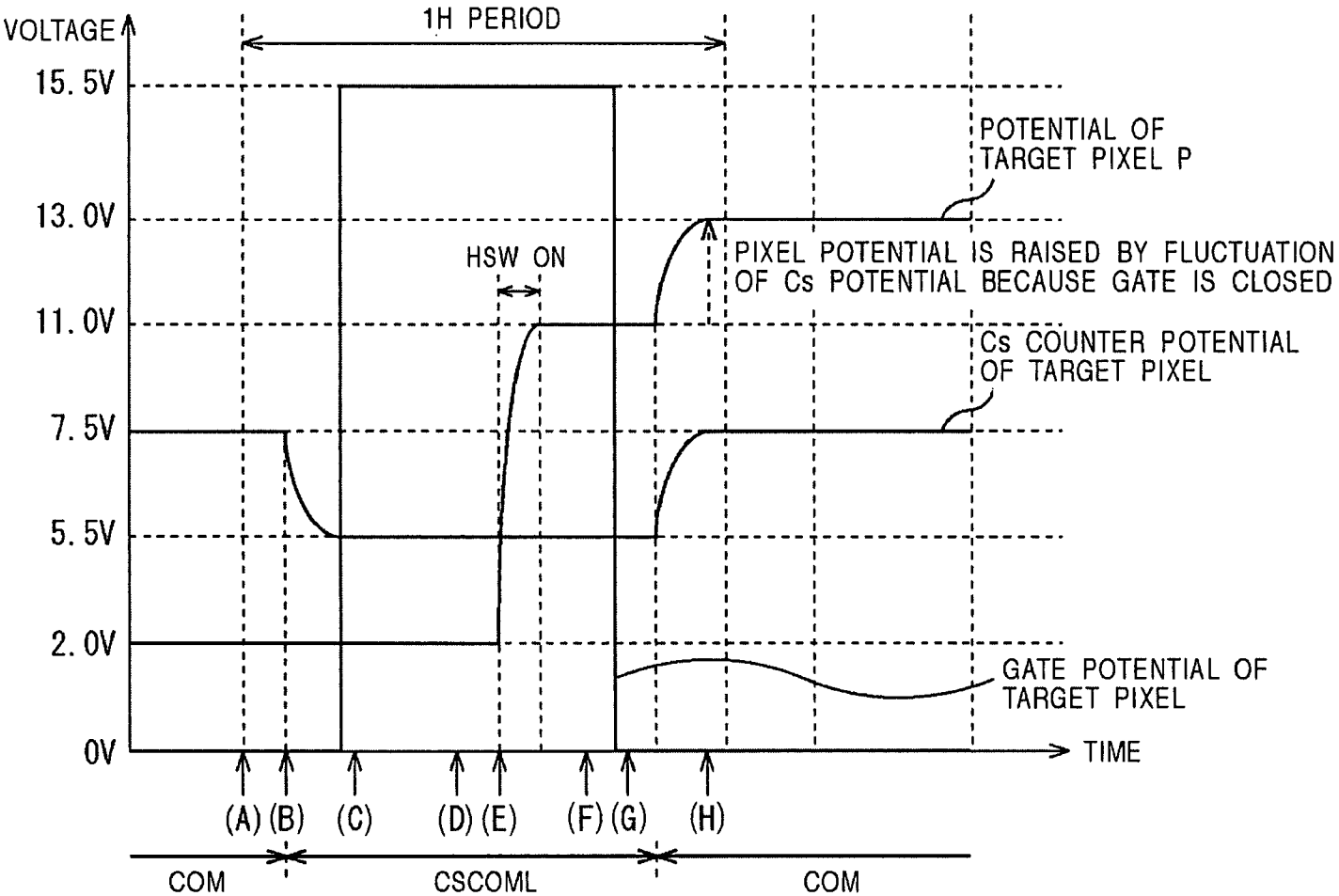
FIG. 8 is an enlarged view of the waveform in FIG. 7.

FIG. 8 is a timing chart enlargedly showing a change in pixel potential from the level "L" to the level "H" at time (1). The axis of ordinate denotes voltage and the axis of abscissa denotes elapsed time in horizontal scanning. After time (A) of horizontal blanking, at time (B), the Cs counter potential of the auxiliary capacitor Cs of the target pixel P is changed from 7.5 V (reference potential COM) to 5.5 V (low potential CSCOML). At time (C), the gate potential of the target pixel P rises, so that the target pixel P is selected. Subsequently, at time (E), the corresponding horizontal switch HSW is turned on, so that the potential of the target pixel P is changed from 2.0 V (level "L") to 11.0 V (level "H"). After that, at time (G), the gate potential of the target pixel P falls and the signal potential is fixed to 11.0 V, namely, to the level "H". Further, at time (G), the Cs counter potential of the auxiliary capacitor Cs in the target pixel P is returned from the low potential CSCOML to the reference potential COM. At this time, the gate has already been closed. Thus, the pixel potential is raised to 13.0 V by an upward shift of the Cs counter potential.

As mentioned above, according to the present invention, before the gate is opened, the potential of the Cs counter electrode is controlled such that it is opposite in phase to the signal potential. Referring to FIG. 8, at time (B), the Cs counter potential is changed to 5.5 V. After that, the signal is written into the corresponding signal line and the corresponding horizontal switch HSW is then turned off. For the signal to be written, the signal voltage is applied in consideration of a voltage drop across the auxiliary capacitor Cs. In this case, at time (E), the signal voltage is set to 11.0 V. After that, approximate at time (G), the gate is closed and the potential of the Cs counter electrode of the auxiliary capacitor Cs is returned to the same potential as that of the counter electrode of liquid crystal. At this time, the gate of the target pixel is closed and the potential (pixel potential) of the transistor is raised by the amount of change in potential of the auxiliary capacitor Cs. Referring to FIG. 8, at time (H), the potential of the target pixel P is raised to 13.0 V. For the change in potential of the auxiliary capacitor Cs, since the auxiliary capacitors are scanned in a manner similar to the gate electrodes, the signal potential of 13.0 V is held for 1F period.

Figure 9:
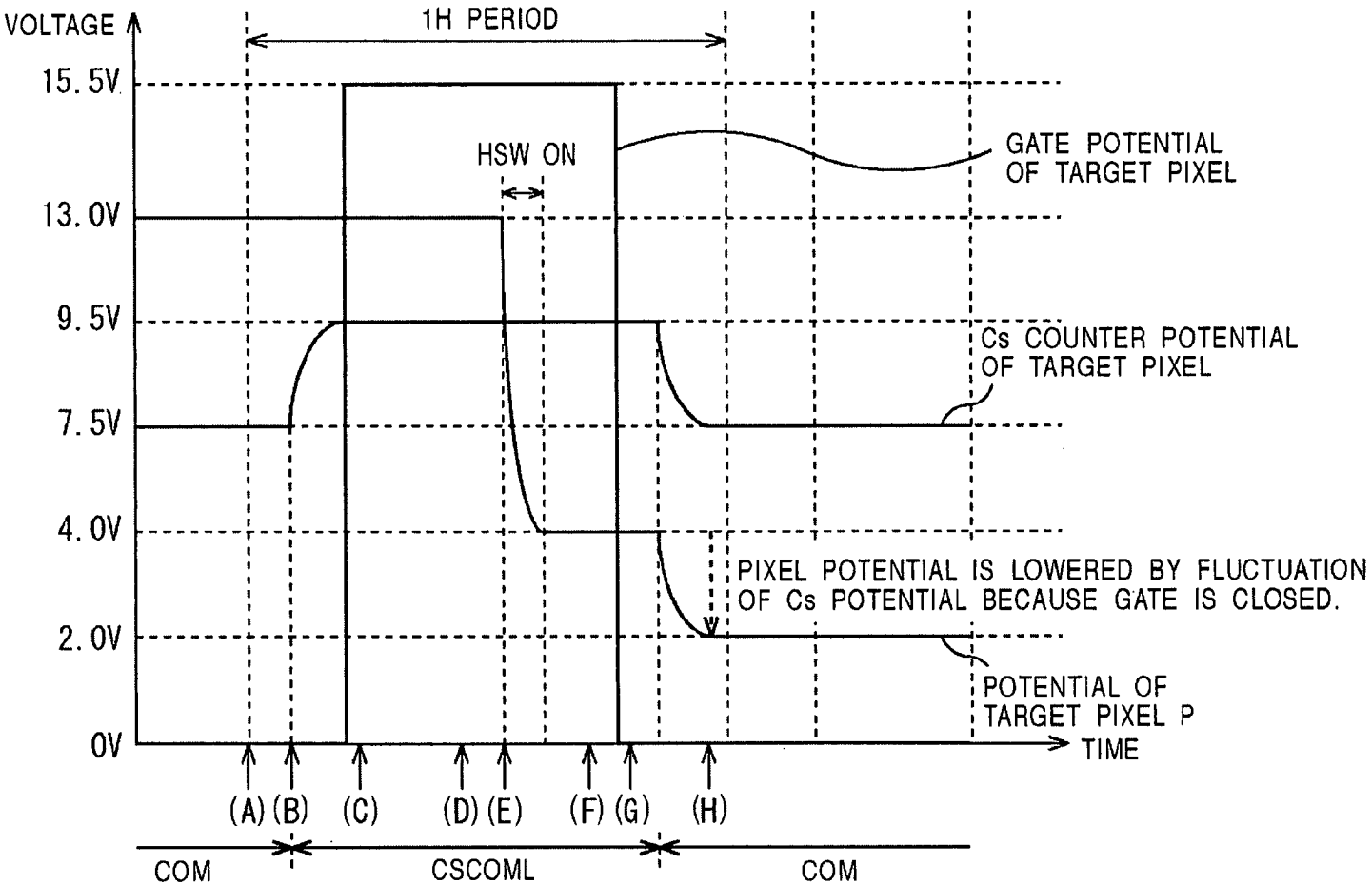
FIG. 9 is an enlarged view of the waveform in FIG. 7.

FIG. 9 shows a change in potential (pixel potential) of the pixel electrode of the target pixel P from the level "H" to the level "L" at time (4) in FIG. 7. Referring to FIG. 9, as in the case of FIG. 8, the potential of the Cs counter electrode of the corresponding auxiliary capacitor Cs is changed just before the gate is opened (at time (B)). The potential of the Cs counter electrode is opposite in phase to the input potential of the signal line (in this case, the Cs counter potential is changed to 9.5 V). After that, the gate is opened and the corresponding horizontal switch HSW is turned on, so that the signal is written into the corresponding signal line (at time (E)). After the gate is closed, the potential of the Cs counter electrode of the auxiliary capacitor Cs is returned to the reference potential (7.5V in FIG. 9). Since the gate is closed, the pixel potential of the target pixel P is influenced by the change in potential of the Cs counter electrode of the auxiliary capacitor Cs. Referring to FIG. 9, since the gate is closed, the pixel potential is lowered by 2.0 V due to the fluctuation in potential of the Cs counter electrode. The Cs counter electrodes of the auxiliary capacitors Cs are scanned in a manner similar to the gate electrodes. Thus, the lowered pixel potential is held at 2.0 V for 1F period.

Figure 10:
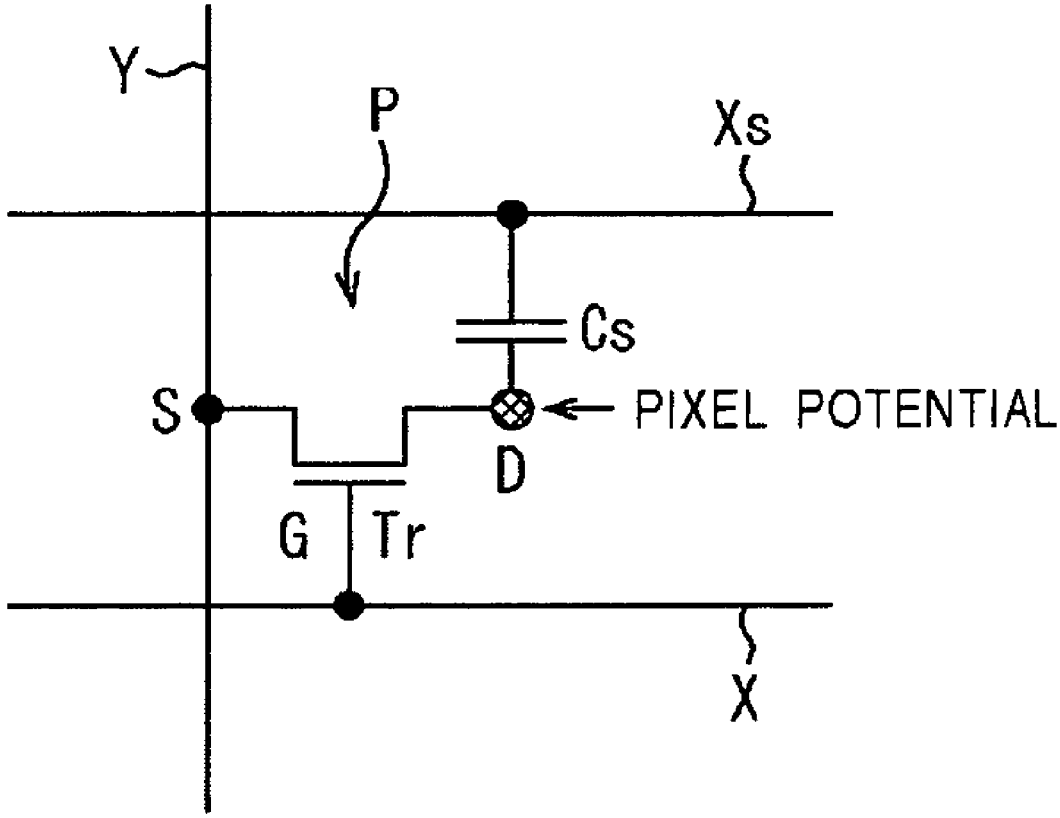
FIG. 10 is an equivalent circuit diagram of the target pixel.

FIG. 10 shows an equivalent circuit diagram of the target pixel P. The target pixel P includes the transistor Tr and the auxiliary capacitor Cs. The gate G of the transistor Tr is connected to the corresponding scan line X, the source S thereof is connected to the corresponding signal line Y, and the drain D thereof is connected to the corresponding pixel electrode. One electrode of the auxiliary capacitor Cs is connected to the drain D of the transistor Tr and the other electrode (Cs counter electrode) thereof is connected to the corresponding auxiliary scan line Xs. According to the present invention, 1H reversal driving and 1F reversal driving are performed with respect to video signals. Consequently, the potential of each pixel electrode is reversed between the level "H" and the level "L" every horizontal period (1H) and every field (1F). Therefore, the source and drain of the transistor Tr change places every horizontal period and every field. At an arbitrary point in time, the pixel potential is equivalent to the drain potential. At another point in time, the pixel potential is equivalent to the source potential. For the field-effect transistor Tr having the above-mentioned gate G, source S, and drain D, namely, the three-terminal type field-effect transistor Tr, the operating point thereof is defined by the potential relationship between the gate G, the source S, and the drain D. According to the present invention, the electrode potential of the auxiliary capacitor Cs is scanned, thereby forcedly changing the operating point of the transistor Tr. Thus, the current drive capacity is enhanced. The present invention is not limited to three-terminal type field-effect transistors. The present invention can also be applied to, for example, four-terminal type field-effect transistors and the same advantages can be obtained.

Figure 11:
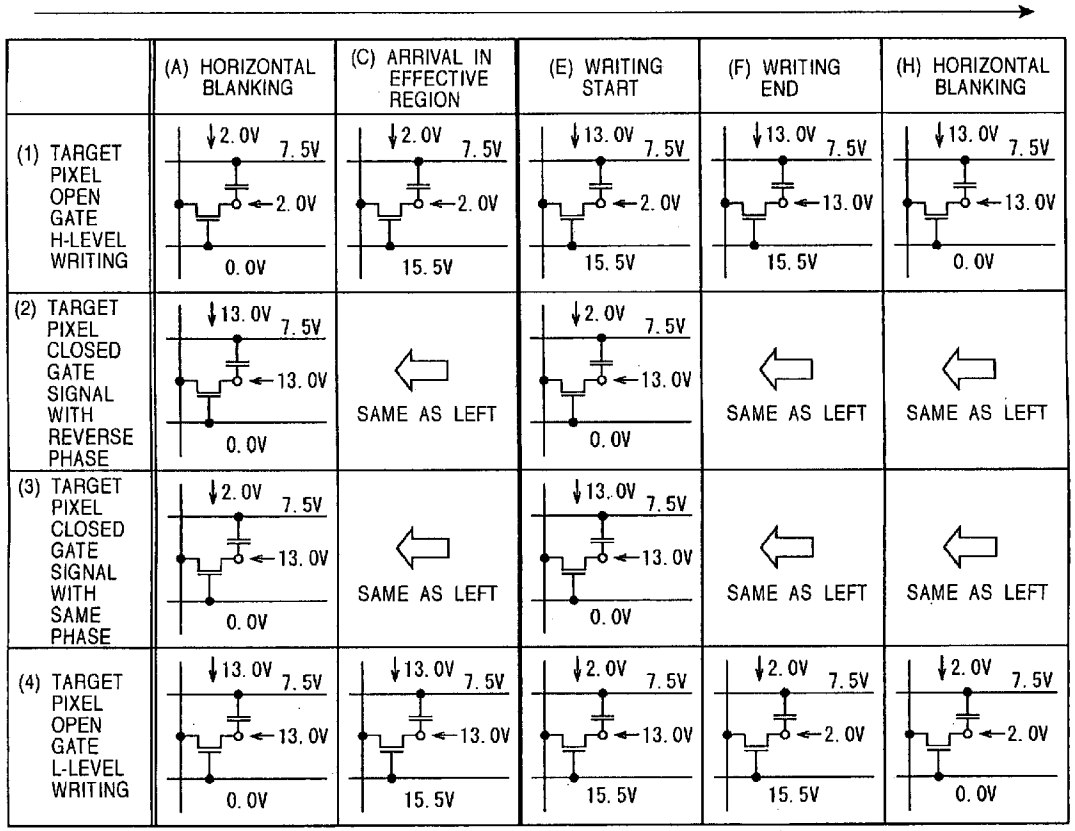
FIG. 11 is a table explaining the operation of the conventional display.

FIG. 11 is a table showing changes in signal line potential, gate potential, and pixel potential of the target pixel P in the conventional display. FIG. 11 shows the changes in two fields. Referring to FIG. 11, elapsed times (1), (2), (3), and (4) in vertical scanning are longitudinally shown and elapsed times (A), (C), (E), (F), and (H) in horizontal scanning are laterally shown. At time (A), horizontal blanking terminates. At time (C), horizontal scanning reaches an effective region of the pixel array. At time (E), signal writing is started. At time (F), signal writing is completed. At time (H), horizontal blanking starts. For one field (1F) period, at time (1), the gate of the target pixel P is opened, so that the signal with a potential at the level "H" is written into the target pixel P. At time (C), the gate is opened. Subsequently, at time (E), writing is performed to the corresponding signal line and 13.0 V is applied. Just after time (F), the gate is closed. In other words, at time (F), the target pixel P is held at the signal line voltage. At time (H), the gate is closed. The pixel potential is then held for 1F period. At time (2), the gate of the target pixel P is closed and a signal supplied to the corresponding signal line is opposite in phase to the signal held in the target pixel P. In other words, potential distribution at time (2) is obtained when a signal with the reverse phase is written into the corresponding signal line while the gate is being closed. On the contrary, potential distribution at time (3) is obtained when a signal with the same phase as that at time (1) is written into the corresponding signal line while the gate is being closed. At time (4), namely, after one field period subsequent to time (1), the gate of the target pixel P is again opened and a signal at the level "L" is written into the target pixel P. At time (C), the gate of the target pixel P is opened. A signal having the potential after one field period is input to the corresponding signal line. After that, the gate is closed.

Figure 12:
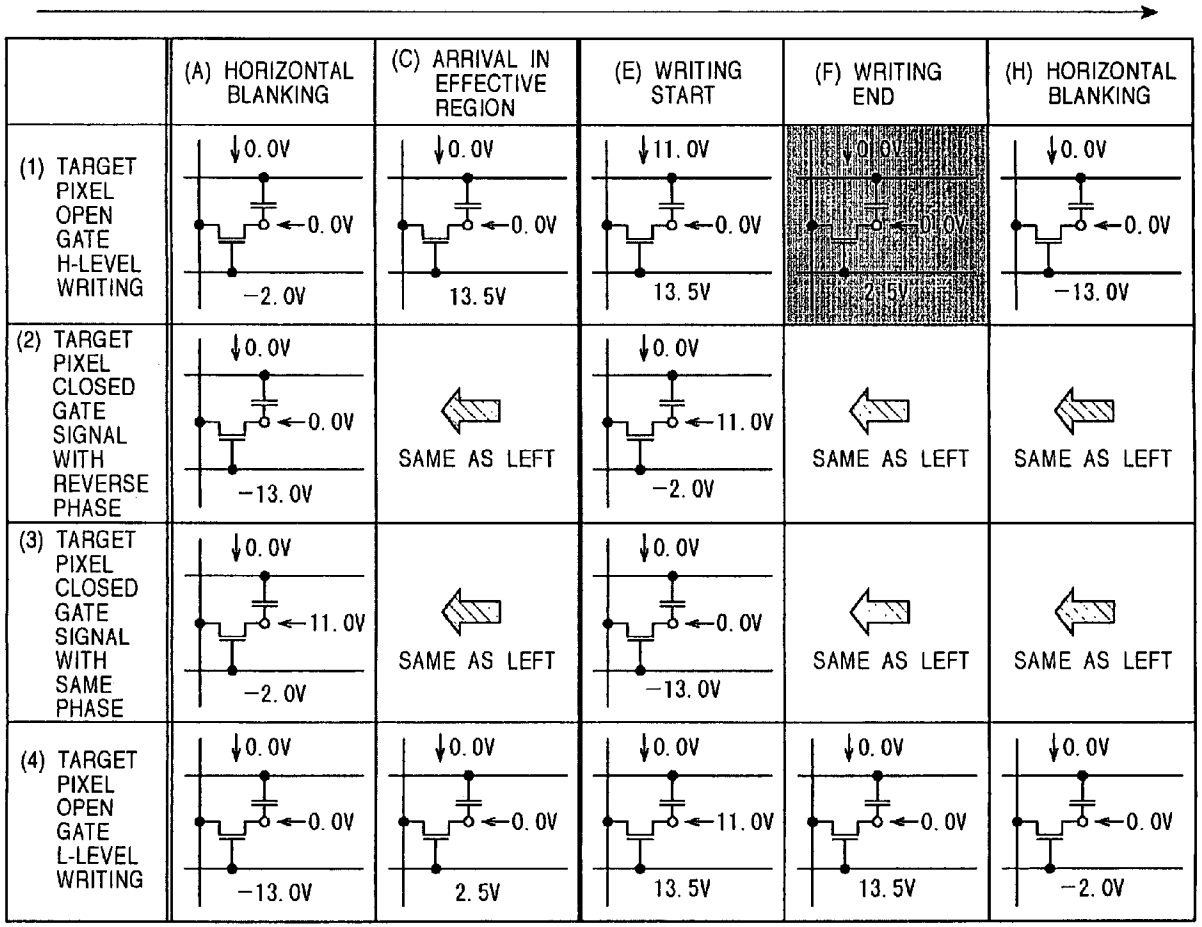
FIG. 12 is a table explaining the operation of the conventional display.

FIG. 12 is a table in which the potential distributions shown in FIG. 11 are rewritten with respect to the transistor of the target pixel P. The potential of the source of the transistor is set to a reference and the gate potential and the drain potential are obtained. In FIG. 12, a voltage applied across the channel of the transistor is considered. The lower potential is set to the source potential as reference. In the viewpoint of the current drive capacity, at time (1)-(F), highlighted by hatching, the potential distribution is in the most difficult situation. The gate potential is 2.5 V. At this voltage level, it is difficult to sufficiently write a signal into the pixel electrode and the auxiliary capacitor. The reason is as follows. Assuming that an N-channel pixel transistor is used, there is no difference in potential between the source and the drain. Consequently, a spot defect caused by insufficient writing is remarkably generated. For the duration from time (2)-(E) to time (3)-(C), the difference in potential between the source and the drain of the pixel transistor is large (voltage across the source and the drain is 11.0 V). This leads to leak. On the other hand, at time (4)-(F), the gate potential is 13.5 V. At this time, it is in the most effective mode for signal writing.

Figure 13:
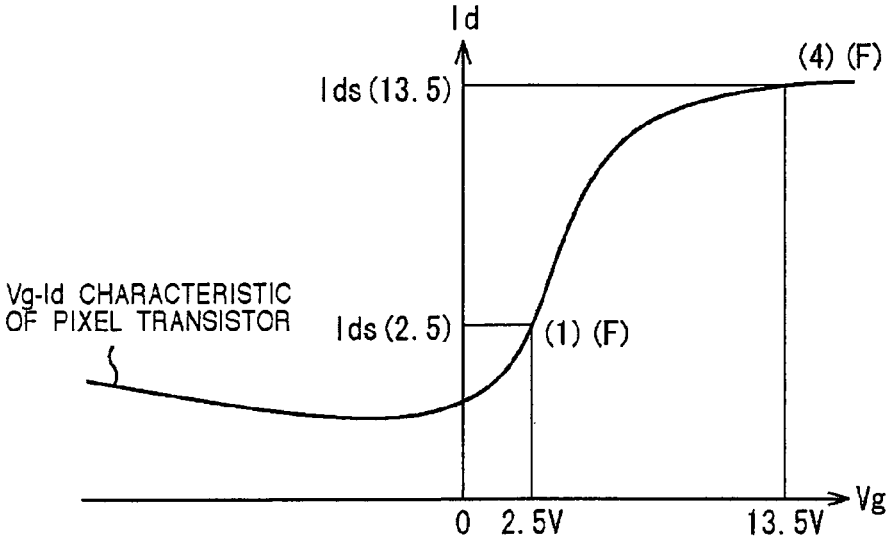
FIG. 13 shows an operating characteristic diagram of a pixel transistor built in the conventional display.

FIG. 13 shows the characteristic between the gate voltage Vg and the drain current Id of the pixel transistor in the conventional display and especially shows the respective operating points at time (1)-(F) and time (4)-(F). For the operating point at time (1)-(F) at which it is difficult to sufficiently write a signal into the pixel, as shown in FIG. 13, the value of Ids is exponentially small in the characteristic of the pixel transistor. Generally, Ids of the transistor is expressed by the following expression, in which Ids (drain-source current) becomes smaller proportional to the square of the gate voltage:

$$Ids=k\{(Vgs-Vth)^2-(Vgd-Vth)^2\}$$

$$k=(\mu\cdot Cox\cdot W)/(2L)$$

where, reference symbol μ denotes mobility; Cox the capacitance of an oxide layer; W the width of the transistor; and L the length thereof.

FIG. 14 shows time-series potential distributions in the target pixel P according to the present invention for a period corresponding to two fields. For the sake of clarity, FIG. 14 shows a table similar to FIG. 12, which shows the case of the conventional display. For time in horizontal scanning, the table of FIG. 14 further includes time (B) at which the potential of the Cs counter electrode starts to vary, time (D) at which the effective region of the pixel array is being scanned horizontally, and time (G) at which the gate is closed. Referring to FIG. 14, at time (1)-(B), the auxiliary scan line connected to the Cs counter electrode of the target pixel P is changed from 7.5 V to 5.5 V. Subsequently, at time (C), the gate is opened. After that, at time (E), a signal at 11.0 V is written into the signal line. For signal input, 11.0 V is applied in consideration of the amount of change of Cs. At time (F), just before the gate is closed, the pixel goes to the same voltage level as that of the corresponding signal line. After that, at time (G), the gate is closed. At time (H), the potential of the Cs counter electrode is returned to 7.5 V that is the original voltage level. After that, the potential is held for 1F period.

Potential distribution at time (2) is obtained when the gate is closed and a signal with the opposite polarity is written into the corresponding signal line. The potential of the Cs counter electrode varies synchronously with the gate potential. So long as the gate is closed, the potential of the Cs counter electrode is not changed. Polarity distribution at time (3) is obtained when the gate is closed and a signal with the same polarity as that at time (1) is written into the signal line. Since the potential of the Cs counter electrode varies synchronously with the gate potential, the potential of the Cs counter electrode is not changed so long as the gate is closed.

Polarity distribution at time (4) is obtained after one field period subsequent to time (1). At time (B), the potential of the Cs counter electrode of the target pixel P is changed from 7.5 V to 9.5 V. At time (C), the gate is opened. At time (E), a signal having the potential after one field period subsequent to time (1) is input to the corresponding signal line. At time (G), the gate is closed. At time (H), the potential of the Cs counter electrode is returned to 7.5 V.

FIG. 15 shows a table in which the potential distributions in FIG. 14 are rewritten with respect to the transistor of the target pixel P. FIG. 15 shows a table similar to FIG. 12. The source of the transistor is set to a reference point and the gate voltage and the drain voltage are obtained. As is obvious from the table of FIG. 15, at time (1)-(F), highlighted by hatching, the potential distribution is in the most difficult situation for signal writing. At that time, the gate potential is 4.5 V. On the contrary, at time (4)-(F), the potential distribution is in the most favorable situation for signal writing. The gate potential is 11.5 V. However, even in the most difficult situation, the gate voltage is 4.5 V which is higher than that in the conventional case in FIG. 13 by 2.0 V. The current Ids flows $\{(4.5-Vth)^2/(2.5-Vth)^2\}$ times as much as the conventional one. For example, assuming that a threshold voltage of the pixel transistor is set to 1V, a current, that is about 5.4 times as much as the conventional one, can flow through the transistor.

On the other hand, the difference in potential between the source and the drain has a large impact on leak. Referring to FIG. 15, the severest condition is continued for the duration from time (2)-(E) to time (3)-(D). As compared to the case where the voltage across the source and the drain in the conventional display is 11.0 V from time (2)-(E) to time (3)-(D) in FIG. 12, the voltage across the source and the drain in the display according to the present invention is 9.0 V that is lower than the conventional one by 2.0 V. Accordingly, the display according to the present invention is resistant to leak.

Figure 16:
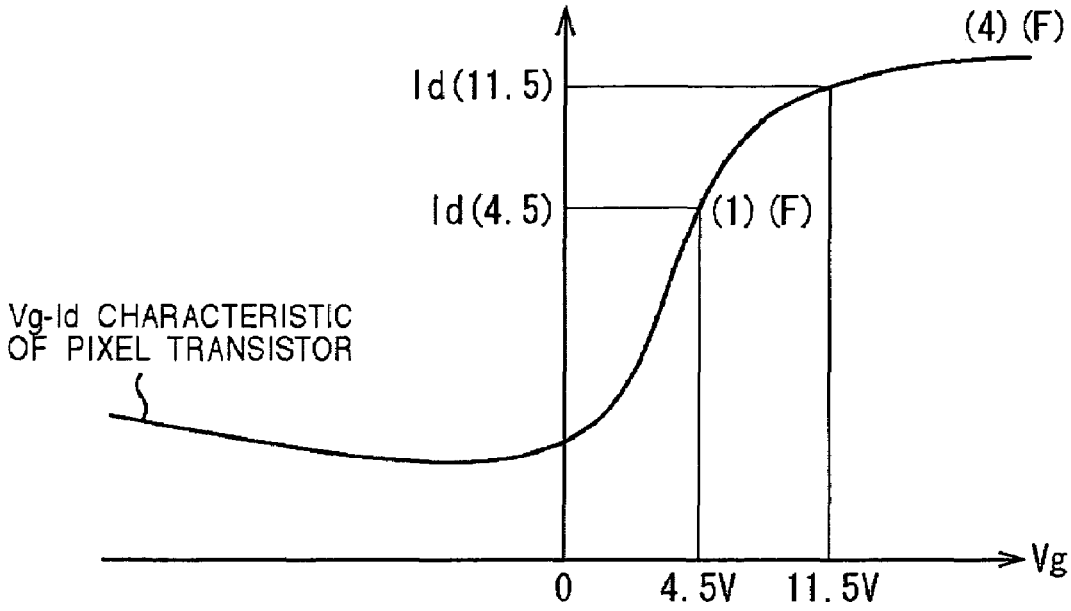
FIG. 16 is an operating characteristic diagram of the pixel transistor built in the display according to the present invention.
Figure 17:
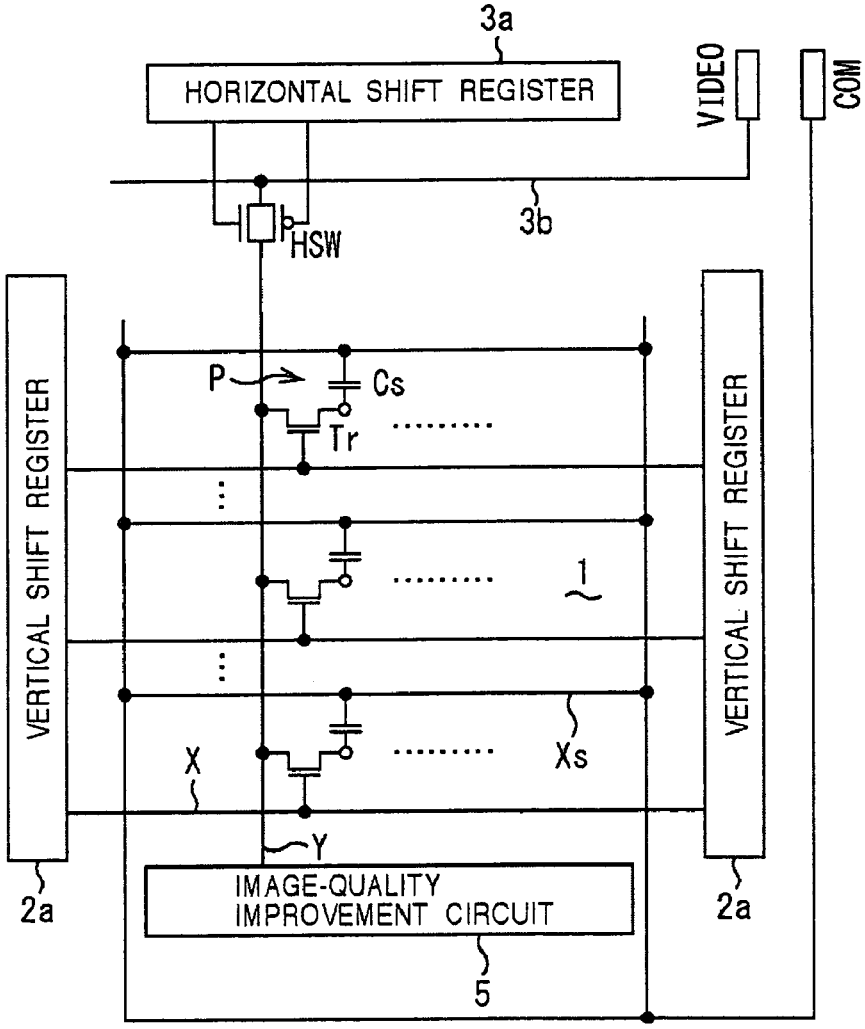
FIG. 17 is a circuit diagram of the conventional display.
Figure 18:
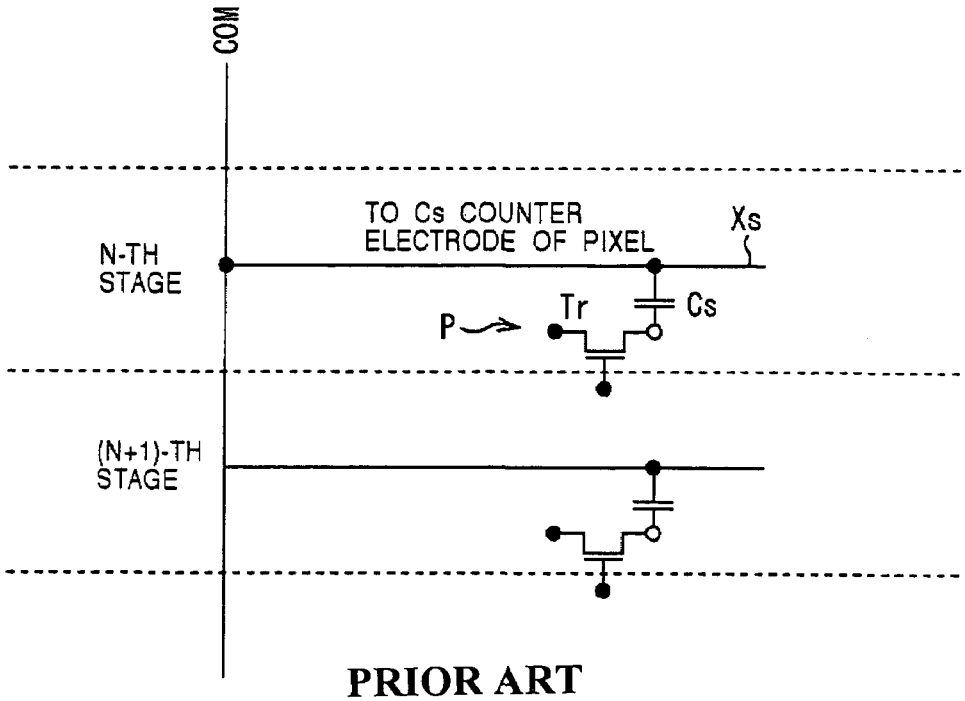
FIG. 18 is an equivalent circuit diagram of pixels of the conventional display.
Figure 19:
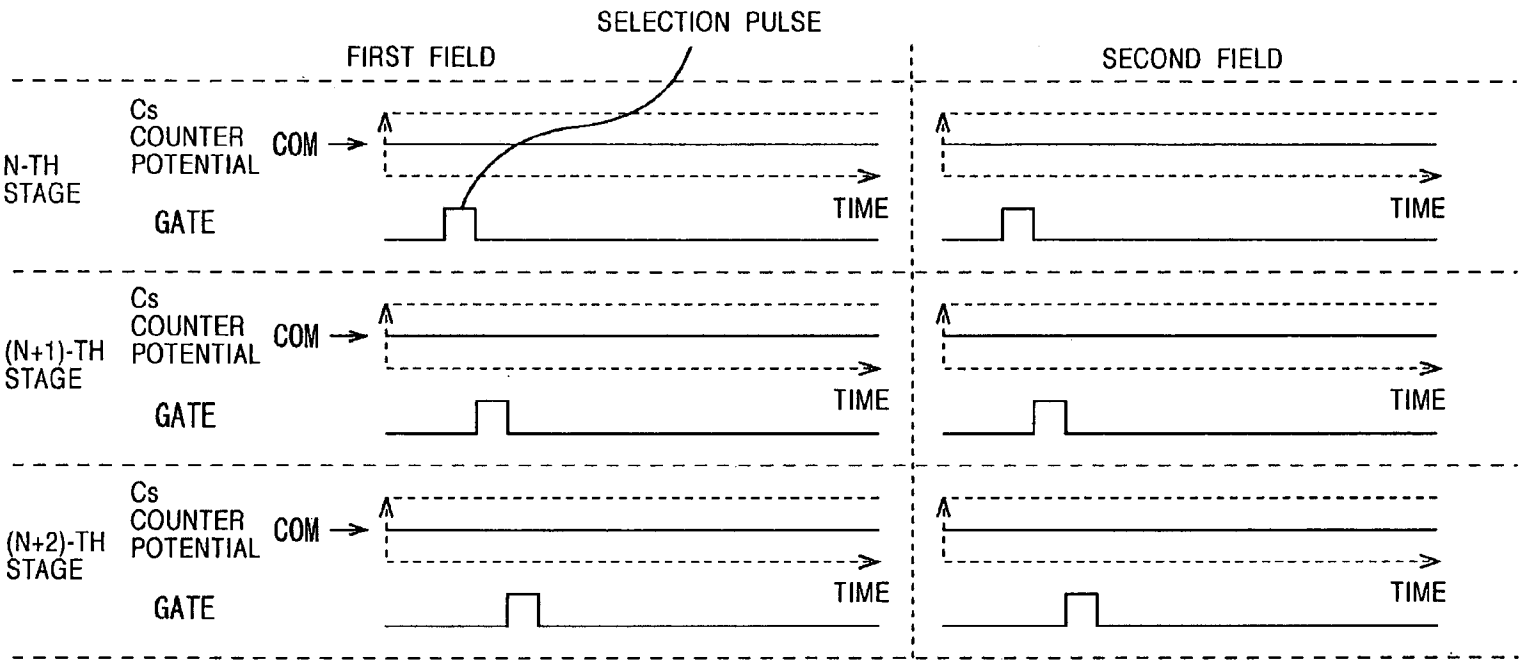
FIG. 19 is a timing chart explaining the operation of the conventional display.

FIG. 16 shows the characteristic between the gate voltage Vg and the drain current Id of the pixel transistor according to the present invention. FIG. 16 especially shows the characteristic at the operating points at time (1)-(F) and time (4)-(F) defined according to the present invention. The effect according to the present invention is enhanced in a region where the gate voltage is low. The value of Ids is increased, thus preventing insufficient signal writing that is the conventional problem. As mentioned above, according to the present invention, the Cs counter electrode of each auxiliary capacitor is scanned synchronously with scanning the corresponding gate and the potential of the Cs counter electrode is applied such that it is opposite in phase to an input potential of the corresponding signal line, thus changing the operating point of the corresponding pixel transistor. It results in the increase in write current to the corresponding pixel. This prevents a spot defect caused by insufficient writing. In addition, this leads to a reduction in potential difference between the source and the drain, thus preventing a spot defect caused by leak. This approach can reduce the input amplitude of a signal, thus effectively eliminating image quality defects such as lateral crosstalk, longitudinal crosstalk, and a window strip, which are conventional disadvantages depending on signal amplitude. On the other hand, according to the present invention, the potential of each counter electrode of liquid crystal is not changed like conventional common reversal driving. Therefore, the display according to the present invention easily makes high-speed scanning possible.

What is claimed is:

1. A display comprising:

a pixel array including scan lines extending laterally, signal lines extending longitudinally, pixels arranged in a matrix so as to correspond to the intersections of the scan lines and the signal lines, and auxiliary scan lines extending parallel to the scan lines;

a vertical scan circuit for sequentially applying selection pulses to the scan lines to sequentially select the pixels row by row;

a horizontal drive circuit for supplying a signal, of which potential is reversed between a high level and a low level relative to a predetermined reference potential, to each signal line to write the signal with a high or low potential to the pixels in the selected row; and an auxiliary scan circuit, operatively associated with the vertical scan circuit, for sequentially applying auxiliary pulses to the auxiliary scan lines, wherein each pixel comprises a transistor, which connects to the corresponding scan line and signal line and conducts in response to the selection pulse, a pixel electrode to which the signal is written through a corresponding conducting transistor, and an auxiliary capacitor for holding the written signal, one electrode of each auxiliary capacitor is connected to a corresponding transistor and another electrode thereof is connected to the corresponding auxiliary scan line that is common to the auxiliary capacitors in the same row, and the auxiliary scan circuit sequentially applies the auxiliary pulses, of which potential is reversed between the high level and the low level relative to the predetermined reference potential, to the auxiliary scan lines synchronously with the selection pulses to control such that the potential of the electrode of each auxiliary capacitor in the selected row is opposite in polarity to that of the signal written in the corresponding pixel electrode in the selected row, and further control such that the potential of the electrode of each auxiliary capacitor is returned to the reference potential when the selected row is released.

2. The display according to claim 1, wherein the horizontal drive circuit reduces an amplitude of the signal, of which potential is opposite in polarity to that of the auxiliary pulse, by the difference between the reference potential and the reversed potential of the auxiliary pulse, and then supplies the resultant signal to each signal line.

3. The display according to claim 1, wherein just before a selection pulse is applied to each scan line, the auxiliary scan circuit applies an auxiliary pulse to the corresponding auxiliary scan line, and stops applying the auxiliary pulse to the auxiliary scan line just after applying the selection pulse is terminated.

4. The display according to claim 1, wherein the horizontal drive circuit writes a signal, of which potential is reversed every row, into each pixel row, and the auxiliary scan circuit applies an auxiliary pulse, of which potential is reversed every row so as to be opposite in polarity to that of the signal, to each auxiliary scan line.

5. The display according to claim 1, further comprising:

counter electrodes facing the respective pixel electrodes, with a predetermined space therebetween, wherein liquid crystal is arranged in the space, each counter electrode is held at the predetermined reference potential, and the potential of the signal written in each pixel electrode and that of the electrode of the corresponding auxiliary capacitor are opposite in polarity to each other and are reversed between a positive potential and a negative potential relative to the reference potential.

6. A method for driving a display comprising a pixel array including scan lines extending laterally, signal lines extending longitudinally, pixels arranged in a matrix so as to correspond to the intersections of the scan lines and the signal lines, and auxiliary scan lines extending parallel to the scan lines, each pixel comprising a transistor, which connects to the corresponding scan line and signal line and conducts in response to a selection pulse, a pixel electrode to which the signal is written through a conducting transistor, and an auxiliary capacitor for holding a written signal, one electrode of each auxiliary capacitor being connected to a corresponding transistor, the another electrode thereof being connected to the corresponding auxiliary scan line that is common to the auxiliary capacitors in the same row, the method comprising;

a vertical scanning step of sequentially applying selection pulses to the scan lines to sequentially select the pixels row by row;

a horizontal driving step of supplying a signal, of which potential is reversed between a high level and a low level relative to a predetermined reference potential, to each signal line to write the signal with a high or low potential to the pixels in the selected row; and an auxiliary scanning step, operatively associated with the vertical scanning step, of sequentially applying auxiliary pulses to the auxiliary scan lines, wherein in the auxiliary scanning step, the auxiliary pulses, of which potential is reversed between the high level and the low level relative to the predetermined reference potential, are sequentially applied to the auxiliary scan lines synchronously with the selection pulses to control such that the potential of the electrode of each auxiliary capacitor in the selected row is opposite in polarity to that of the signal written in the corresponding pixel electrode in the selected row, and further control such that the potential of the electrode of each auxiliary capacitor is returned to the reference potential when the selected row is released.

* * * * *